US011725910B2

(12) United States Patent
Mazo et al.

(10) Patent No.: US 11,725,910 B2
(45) Date of Patent: Aug. 15, 2023

(54) BALLISTIC AND ATHLETIC PERSONAL PROTECTIVE EQUIPMENT

(71) Applicant: CARBONYL CHEMICAL CONSULTING LLC, Fort Wayne, IN (US)

(72) Inventors: Jacob Mazo, Dyer, IN (US); Grigory Mazo, Dyer, IN (US)

(73) Assignee: CARBONYL CHEMICAL CONSULTING LLC, Fort Wayne, IN (US)

( * ) Notice: Subject to any disclaimer, the term of this patent is extended or adjusted under 35 U.S.C. 154(b) by 0 days.

(21) Appl. No.: 18/075,094

(22) Filed: Dec. 5, 2022

(65) Prior Publication Data

US 2023/0118690 A1 Apr. 20, 2023

Related U.S. Application Data

(63) Continuation of application No. PCT/US2021/035513, filed on Jun. 2, 2021.

(51) Int. Cl.
*A41D 13/00* (2006.01)
*F41H 5/04* (2006.01)
(Continued)

(52) U.S. Cl.
CPC ..... *F41H 5/0492* (2013.01); *A41D 13/0158* (2013.01); *A41D 13/0568* (2013.01)

(58) Field of Classification Search
CPC .. A41D 13/0518; A41D 27/28; A41D 13/015; A41D 31/14; A41D 13/0568;
(Continued)

(56) References Cited

U.S. PATENT DOCUMENTS 4,451,934 A 6/1984 Gioello
6,182,299 B1 2/2001 Chen
(Continued)

FOREIGN PATENT DOCUMENTS

CN 202160741 U 3/2012
DE 102011016482 A1 10/2012
(Continued)

OTHER PUBLICATIONS

Weinstock, Jonathan, et al., "Failure of Commercially Available Chest Wall Protectors to Prevent Sudden Cardiac Death Induced by Chest Wall Blows in an Experimental Model of Commotio Cordis"; Pediatrics vol. 117, No. 4, Apr. 2006, e656-e662.
(Continued)

*Primary Examiner* — Michael D David
(74) *Attorney, Agent, or Firm* — Bycer & Marion, PLC; Matthew L. Bycer; Michael B. Marion

(57) ABSTRACT

Ballistic and athletic personal protective equipment utilizing rigid panel(s) featuring designs for improved cooling employing "stack effect" airflow in combination with optimized wearer contact surface geometry. Improved ballistic and athletic personal protective equipment designs contain rigid panel(s) for protection of wearer from impacts, ballistic threats and the like. The equipment is provided with spacers arranged to provide a stack effect powered airflow between rigid panel(s) and wearer, cooling the same. The spacers are further designed, dimensioned and arranged to provide optimal heat transfer and mass transfer efficiency from wearer to cooling air within the protective equipment system, providing optimal cooling effects. The system is simple, light, and inexpensive, providing improved wearer comfort and safety from hyperthermia for optimal performance at elevated temperatures.

22 Claims, 14 Drawing Sheets

(51) Int. Cl.
*A41D 13/05* (2006.01)
*A41D 13/015* (2006.01)

(58) Field of Classification Search
CPC ..... F41H 1/02; F41H 5/0492; A41B 2400/20; A41B 9/00; A41B 9/06; A41B 9/12
USPC ..... 2/2, 463 OR, 113 OR, 2.5 OR, 92 OR, 2/256 OR, 455 OR, 464 OR, 468 OR, 2/DIG. 1; 89/36.05; 109/49.5; 428/911
See application file for complete search history.

(56) References Cited

U.S. PATENT DOCUMENTS

| | | | | |
|---|---|---|---|---|
| 6,678,899 | B2 | 1/2004 | Fiorini et al. | |
| 6,826,786 | B2 | 12/2004 | Fiorini et al. | |
| 6,892,392 | B2 | 5/2005 | Crye et al. | |
| 7,093,301 | B1 | 8/2006 | Moore, Jr. | |
| 7,437,883 | B1 | 10/2008 | Baidal | |
| 7,735,161 | B2 | 6/2010 | Purington | |
| 8,037,804 | B1 * | 10/2011 | Wahlquist | F41H 5/007 89/917 |
| 8,756,718 | B2 | 6/2014 | Tymofy | |
| 8,757,041 | B1 * | 6/2014 | Gillen | F41H 5/045 2/2.5 |
| 8,853,891 | B2 | 10/2014 | Soar | |
| 8,959,671 | B1 | 2/2015 | Mandak | |
| 9,772,166 | B2 | 9/2017 | Shelton | |
| 2004/0003456 | A1 * | 1/2004 | Nishimoto | A63B 71/12 2/463 |
| 2006/0005306 | A1 | 1/2006 | Call et al. | |
| 2009/0255037 | A1 * | 10/2009 | Sandusky | B32B 27/08 428/44 |
| 2012/0079647 | A1 | 4/2012 | Doherty et al. | |
| 2012/0153740 | A1 | 6/2012 | Soar | |
| 2016/0316830 | A1 * | 11/2016 | Roque | A41D 27/28 |
| 2018/0014961 | A1 * | 1/2018 | Mylonas | F41H 1/02 |
| 2018/0077991 | A1 * | 3/2018 | Horstemeyer | A42B 3/065 |
| 2018/0249133 | A1 * | 8/2018 | Thiel | H01M 50/256 |
| 2021/0137181 | A1 * | 5/2021 | Patel | A41D 31/145 |

FOREIGN PATENT DOCUMENTS

| | | |
|---|---|---|
| KR | 20140095692 | 8/2014 |
| WO | WO2008072011 A1 | 6/2008 |

OTHER PUBLICATIONS

Kaplan, James, et al., "Commotio Cordis in Two Amateur Ice Hockey Players Despite the Use of Commercial Chest Protectors: Case Reports"; The Journal of Trauma, vol. 34, No. 1, Jan. 1993, pp. 151-153.

Maron, Barry J., et al., "Clinical Profile and Spectrum of Commotio Cordis", JAMA Mar. 6, 2002; vol. 287, No. 9, pp. 1142-1146.

Boden, Barry, et al., "Fatalities in High School and College Football Players", Am. Journal of Sports Med. 2013; vol. 41, No. 5, pp. 1108-1116.

National Institute of Justice (NIJ), "Ballistic Resistance of Body Armor, NIJ Standard-0101.06", Jul. 2008, (89 pages).

Roberts, Gregory, DC, CES, "Gunfighter Anatomy: Proper Wear of Armor", uprighthealth.us, updated Apr. 26, 2014 (7 pages).

* cited by examiner

BALLISTIC AND ATHLETIC PERSONAL PROTECTIVE EQUIPMENT

CLAIM OF PRIORITY

The present application includes subject matter disclosed in and claims priority to a PCT application entitled "Ballistic And Athletic Personal Protective Equipment" filed Jun. 2, 2021 and assigned Serial No. PCT/US21/35513, and to a provisional application entitled "Ballistic Protective Wear" filed Jun. 4, 2020 and assigned Ser. No. 63/034,779, and provisional application entitled "Ballistic and Athletic Personal Protective Equipment" filed Dec. 3, 2020 and assigned Ser. No. 63/121,128, all describing inventions made by the present inventors, herein incorporated by reference.

BACKGROUND OF THE INVENTION

1. Field of the Invention

The present invention relates to the use of various articles of protective clothing containing rigid elements, now often termed "panels" and intended for personal protection against injury by objects, has long been known to the art of protection from ballistic, impact, edged, and other threats, dating back to antiquity. Such devices currently find very wide ranges of use, from sporting to industrial to security applications, among others. Users of various protective equipment encompass almost the entire population, from children of relatively young age upwards. A range of materials and combinations thereof, possessing suitable properties, has been employed in making the panels (or their equivalents), and a large variety of systems designs has been created and utilized to locate the panels on wearers for protection of same from injury that could be inflicted by various threats and means. The various user-wearable systems are employed to suitably locate the panels on the wearer's body in such a way as to simultaneously protect vitally important organs of same from injury, provide for relatively low impediment to wearer mobility and activity, and satisfy a number of other additional requirements well known to the art of making protective equipment and varying according to a specific device's intended use. Among those requirements that are common to all applications are prevention of excessive panel displacement from original intended location during activity, ease of donning and doffing, user comfort, durability, adjustability to different body shapes and sizes of wearers, etc. The composition of rigid protective panels and their specific properties for each application are varied according to a variety of considerations known to the art.

A further aspect of protection known to the art of producing protective equipment is the prevention (or at least significant mitigation) of blunt trauma to the wearer's thoracic region and nearby regions. One such type of trauma is a certain type of impact to the region of a user's chest known as the precordium due to various conditions, such as impacts of sporting implements of assorted varieties, including but not limited to balls, pucks, sticks, other sporting implements, as well as impacts caused by other sporting event participants, among others. Such impacts are known to create a risk of a number of different types of injury, and among those is a highly dangerous and usually fatal condition termed "commotio cordis" that has been recognized by the medical community since at least the 1800's. The condition is highly problematic because it occurs with no warning whatsoever in otherwise completely healthy and even highly athletic individuals, usually exhibits a rapid onset of only a few seconds, and is mostly fatal even with immediate correct diagnosis, when the best medical attention and heroic efforts are applied to assist victims within seconds of visible onset. The condition mostly afflicts those between about 3 and about 25 years of age. While there exists a significant body of knowledge regarding the potential causes of onset of the condition, existing protective devices on the market are known to offer insufficient protection against said known causes.

Yet further, a wide range of sports such as various equestrian disciplines, various sports including the use of motorcycles, all-terrain vehicles (ATV's), bicycles, and several others are also well known for the use of various protective equipment intended to reduce and/or prevent injury to the users of same, including but not necessarily limited to, injuries to the torso and nearby areas of the user's body. The specific areas and elements of construction of these pieces of protective equipment are well known to the art.

At this time, in certain other applications, protective panels are intended to protect the wearer's torso region from ballistic projectiles originating from various firearms; they are sometimes termed "ballistic panels". Such ballistic panels may be divided into two main groups, namely those that are relatively more flexible, and those that are relatively rigid. Flexible (sometimes termed "soft") ballistic panels are generally relatively lighter, are largely composed of one or more types high tensile strength (HTS) fiber(s) arranged in a variety of ways, and are often comparatively thinner than other designs, mostly on the order of about 3 mm to about 10 mm thickness. As their name implies, they are relatively soft and are used in a way where they conform, in a general sense, to the wearer's body when worn. They are structured in a variety of ways known to the art, where the actual ballistic panel(s) is/are enclosed in various carriers, said carrier(s) usually composed largely of textile materials of various kinds. The carriers themselves do not provide ballistic protection, but serve to position the ballistic panel(s) contained therein on the wearer's body in an appropriate fashion to provide desired coverage in an easily adjusted and comfortable way, and may also optionally provide other additional functions as well. A wide range of carriers and their designs are well known to the art and are commercially available. The actual fibers involved in a soft ballistic panel's threat resistance are typically, but not exclusively, various aramid, ultrahigh molecular weight polyethylene (UHMWPE), and similar HTS fibers, and are also well known to the art of ballistic protection. In practice, these "soft" panels in combination with suitable carriers and optional additional elements (e.g., those intended for protection against strikes and/or stabbing attacks) are often termed "soft body armor" and are commonly used by law enforcement officers, security personnel, and the like. Soft body armor has a long record of successful and widespread use, and is highly effective against numerous ballistic threats having certain combinations of characteristics that result in relatively lower armor penetration capability, i.e. projectiles that are distinguished by possession of certain combinations of comparably lower velocity, larger diameter, and softer material(s) of construction. The general range of likely ballistic threats is described in relevant US National Institute of Justice (NIJ) standards, such as NIJ Standard-0101.06 (incorporated herein by reference in its entirety). Ballistic panels of the type(s) intended for stopping projectiles possessing lower penetration capability are generally classified in accordance with that standard as Levels IIA, II, and IIIA.

However, the panels meeting these specifications are ineffective at protecting the wearer against a wide range of other ballistic threats they are, logically, not intended to defend against. Such threats are generally (but not exclusively) originating from firearms employing nominally "rifle caliber" rounds, possessing (among other factors) some combination(s) of higher velocities, lower diameters, harder materials of construction. Such projectiles possess combinations of properties that make them capable of defeating certain versions of body armor. It is well known to the art that the inability of Level IIA, II, IIIA ballistic panels to stop such threats is not a defect of these armor types, since other ballistic panel types are available to address the threat of projectiles possessing higher penetration capabilities.

The NIJ Standard further provides for armor panels of Level III and Level IV, which are effective against a much wider range of ballistic threats than the other panel types mentioned above; typically, these higher performance panels are termed "hard" due to the fact that they are generally rigid units, a condition resulting from materials and methods of construction necessary to meet these higher levels of protection specified in the NIJ standard. They are highly effective against a wide range of projectiles possessing various combinations of high speed, small diameter, and hard materials of construction (as described in the standard). While a wide range of materials is employed in the construction of such panels, the most common materials included are steel and other metal alloys, ceramic materials of different types, and UHMWPE; frequently additional materials such as HTS fibers and/or various coatings are used on the outer and/or inner surfaces of these panels to protect them from damage in use, and to prevent panel and/or projectile fragments from injuring the wearer in case of impacts to plate by ballistic threats. Sometimes a Level IIA, II, or IIIA panel is intended to be used in conjunction with a hard armor panel, the lower-rated panel being located between the hard armor panel and wearer, for the purposes outlined above. Certain hard armor panels require these additional panels (of a specific rating specified by manufacturer) to be present and installed properly to meet the claimed NIJ standard specifications for the combination of the two panels as a unit; these are sometimes termed "in conjunction" panels, as opposed to "standalone" panels that meet the relevant NIJ standard without any additional elements. While more effective than other armor types in the sense of providing protection against a wider threat spectrum, these types of armor panels, commonly termed "hard body armor" also possess a variety of well-known disadvantages in use. "Hard body armor" also often refers to the combination of hard armor panel(s), any soft armor panel(s) employed in conjunction with same, and carrier(s) intended to enable the wearing of the ballistic panel(s) by the user in appropriate location(s) on the body. In this document, unless otherwise specified, the term "hard armor panel" includes both standalone hard armor panel varieties of all NIJ levels (and similar panels meeting other generally analogous standards promulgated by other entities) and the combinations of "in conjunction" hard armor panels of all varieties with suitable soft armor panels as directed by manufacturer/supplier.

One widely known disadvantage of all ballistic armor is its significant weight. It is known that panels capable of stopping a wider spectrum of threats tend to be heavier and/or thicker than similar ones with protection against a narrower spectrum of threats, when the technology employed for both panels and their coverage area are same. Therefore, it is advantageous for the panel carrier elements of a body armor system (sometimes termed "plate carriers") to be relatively lightweight, so the armor system as a whole is as light as possible. At similar protection levels (Level IIIA), a hard ballistic panel usually allows a somewhat smaller coverage area, but has a lower weight, is relatively thin, and is often lower in cost, when compared to a soft ballistic panel, but lacks flexibility.

Typically, when relatively low penetrating power ballistic threats are expected, soft armor is used (e.g., Level II, or IIIA). When higher penetrating power threats are believed possible or likely (mostly from nominally rifle-cartridge-employing firearms), hard armor is used (e.g., Level III and/or IV). However, there are currently on the market some hard armor panels that are intended for use against lower penetration ability threats (Level IIIA) that perform in generally similar fashion to soft panels in terms of ballistic resistance while being rigid; they are characterized by advantageously low weight of about 7 kg per square meter or less and tend to be about 5 mm thick, making them convenient in some applications. Although their coverage area in typical plate sizes is not as extensive as many soft armor panels, rigid ones are advantageously lighter, can be available at low cost, and can resist various impacts better than plain soft armor; these are useful combinations of features in some applications.

Various sports (including but not limited to baseball, softball, hockey, lacrosse, football, cricket) involve a wide range of protective equipment worn by some or all participants; in many cases it has become known that the existing designs offer poor protection against commotio cordis, and the protective elements of said equipment are generally made up of various foam and foam-like materials, alone or in various combinations, and often enclosed in various optional textile outer coverings. Also known is the use of various small-polymeric-particle-filled structures as part of these designs, where the particles are intended to deform and absorb impact energy when struck. Some may further include optional rigid polymeric elements as part of their construction. However, in all cases, the products currently available involve well over 50% of the equipment's inner (wearer-facing) surface area in intimate contact with the wearer's clothing. It is suspected that as a result, existing equipment designs' structures transmit at least a large fraction of impacts inflicted on them during use to the thoracic region of the wearer, and that this may lead to the widely known poor levels of protection against commotio cordis. Further, this leads to poor protection against other impact-induced injuries, and to elevated risk of hyperthermia injury, heat stroke, and discomfort.

Equestrian sports also often involve the use of various protective vests; such articles are known to be useful for injury prevention and/or reduction when worn appropriately and for certain types of injury in the protected areas; however, their use is often problematic due to user comfort issues and overheating that is possible while wearing same. They generally are made with various foam and similar elements; some known designs contain a plurality of smaller rigid elements in combination with softer foam elements, the combinations being intended to be worn in intimate contact with the wearer's clothing. The products currently available involve well over 50% of the equipment's inner surface area in intimate contact with the wearer's clothing.

An additional element of further and very significant disadvantage in using all the protective equipment types discussed above concerns its use by wearers at elevated environmental temperatures and/or while performing strenuous physical activity. It is well known that there exists a significant risk of severe discomfort, heat exhaustion, heat stroke, and similar injury that could lead to loss of effectiveness, loss of mobility, cognitive impairment, severely decreased and/or degraded performance, creation of disability, or even death by wearers of protective equipment of all types when performing various activities. These include, but are not limited to, sporting activities discussed above, running, carrying people and/or objects, climbing stairs, and even rapidly walking. This is especially problematic during activities at elevated outdoor and/or indoor temperatures, and also activities taking a more extended period of time, as well as during warmer and/or humid seasons. The high level and rapid onset of heat-induced discomfort by wearers of protective equipment is also widely known to frequent users thereof, such as athletes, athletic trainers, law enforcement and security personnel, military, etc. The problem is sometimes so severe that personnel refuse to use protective equipment due to the risks associated with thermal discomfort and injury, reduced mobility, and effectiveness loss associated therewith. This can lead to increased hazards to personnel. A wide range of devices and techniques have been proposed by prior art which tried to address this problem, but many have been found to be unsatisfactory, difficult to use, uncomfortable, or of limited applicability in practice. Further, a large number of attempted solutions to this problem in the area of athletic protection equipment have been shown to be ineffective at protecting users from impacts likely to result in commotio cordis or other related types of injury. As can be appreciated from the foregoing, due to typically higher weight and resulting greater physical exertion during activities (when compared to soft armor of similar coverage), an especially problematic situation related to risk of heat-induced user injury, or at least heat-induced loss of performance during strenuous activity, exists for personnel using hard body armor (mostly Level III and IV, or similar), and it is especially desirable to provide a way to improve cooling for users of hard armor panels in ways that overcome prior art deficiencies.

Further, the absence of convenient methods for using rigid protective elements in sporting equipment protective garments of all varieties has been possibly due to a heretofore extant difficulty in providing them in devices with a combination of adequate cooling airflow and wearer comfort. The deleterious effect of protective equipment that results in severe loss of athletic performance and raise significantly the risk of athlete injury due to hyperthermia and related causes is well understood to be a problem in the art.

An important aspect of heat-induced problems experienced by users of protective equipment in general, and users of hard body armor systems and athletic protective equipment in particular, is the loss of the ability of the user's body to be cooled by ambient air in areas covered by the rigid ballistic panel's carrier, or similar loss of cooling via ambient air circulation over areas covered by protective athletic equipment of various types and designs. Protective equipment is generally a good barrier to air flow and a good thermal insulator (this is especially true of the ballistic panels and soft elements of athletic protective equipment, as well as the carriers of ballistic panels). Therefore, it is logical to conclude that if the user's body could be cooled by adequate flows of ambient air over the area(s) protected by protective panel(s), the overheating issues would be significantly reduced, heat-related dangers to wearers of protective equipment of all types would be decreased, and personnel comfort and performance would be improved greatly. The advantages of having personnel wear protective equipment of improved effectiveness that is appropriate to their activity are well known, and the significant advantages of wider use of protective equipment due to its improved cooling are well understood by those skilled in the relevant arts. To date, however, devices containing rigid protective panels and simultaneously enabling suitable cooling air flow by relatively simple, inexpensive and convenient means have not been available to the art.

Thus, the goal of the instant invention consists of making improvements to wearable protection systems that employ (a) rigid protective panel(s), by providing these systems with improved and highly effective means for creating greater cooling air flow in the space between wearer and panel(s). The heat-related issues described above can severely affect athlete performance and can even endanger the participant's health, and are similarly dangerous to wearers of ballistic protective articles. The need for protective equipment and the issues of wearer cooling associated therewith are also well known to makers of protective equipment used in sports such as equestrian, baseball, cricket, football, and many others of a nature where participant protection against physical injury in and around the torso region is desirable. This is similarly well understood by makers of various ballistic protective clothing, devices and gear. Examples include, but are not limited to, the following:

- protective vests for equestrian use in a variety of equestrian sports
- protective equipment for use by baseball, softball, lacrosse, cricket players and the like in general, and especially baseball catchers
  - protective vests and gear for cycling and off-road sports, both traditional cycling and various power sports (ATV's, motorcycles, and the like)
  - protective vests and other equipment for football players and hockey players
  - ballistic protective vests, devices, systems and gear For all these and related sports and activities, a wide range of protective equipment that includes, but is not necessarily limited to, coverage of the torso area is known to be in common use. The location and extent of coverage and protection type in each individual instance is varied and is well known to the art of athletic and sporting protective equipment manufacturing, as well as manufacturing of various ballistic protective and tactical equipment, gear and the like.

2. Description of Related Prior Art

An example of prior art system for general application to preventing heat injury of personnel wearing ballistic body armor has been disclosed by R. Baldal in U.S. Pat. No. 7,437,883. The system includes a flexible hose for transporting cold air originating from a motor vehicle's air conditioning system to the interior of a body armor, and a variety of additional parts for making suitable connections on both ends of the hose, one end being connected to the vehicle's onboard cold air source, and another end connected to the wearer. The system thus employs a forced air flow over the internal surface (one facing the wearer) of the frontal body armor panel's carrier to enhance wearer comfort and to accomplish cooling, a useful feature.

While the system is useful, its main disadvantages are obvious. The user of such a cooling system is not able to take advantage of it when operating away from immediate proximity to the vehicle so equipped, while the most likely wearer activity involving strenuous exertion and subsequent overheating is almost always occurring away from said vehicle; as a result, the system is not available for use when and where the user needs its cooling most. Further, the system generally only cools the frontal side of the body, while the other (dorsal) area remains without any cooling. This prior art illustrates the importance of using air flow in the space between a carrier's interior (i.e., wearer-facing) surface and wearer's clothing to provide cooling, but the means of achieving this air flow are not available when they are needed most. Further, the interior of an air-conditioned vehicle is generally sufficiently cool enough already to render additional user cooling less necessary, further illustrating the significant limitations of this prior art solution.

A garment used for enabling ventilation between body armor and the garment itself by means of parallel raised ribs incorporated into said garment has been disclosed by D. Gioello in U.S. Pat. No. 4,451,934. This prior art teaches the use of a garment located between wearer's body and the inner surface of the ballistic panel carrier. However, wearing garments having such ribs as described in this prior art may be uncomfortable. The ribs, if they are to be of sufficient size to allow for good ventilation via interstices between them, have to be of significant diameter, and they simultaneously have to be fairly rigid, if they are not to be collapsed by wearer movement and the significant weight of ballistic panels and their carrier being worn. In other words, if the prior art invention is practiced with relatively soft ribs, they will collapse and the venting function of the garment will fail. If it is practiced with relatively rigid ribs to prevent ventilation failure, the discomfort of wearing a garment containing a significant number of relatively rigid, large diameter vertical elements is easily appreciated. Further, heat loss from wearer covered with relatively thick clothing is known to be sub-optimal at best. Thus, there remains a need for improved solutions to the cooling problem of ballistic protection garments that provides improved cooling.

A generally similar garment to the one in '934 and intended be worn under a ballistic vest has been disclosed by C. Tymofy in U.S. Pat. No. 8,756,718. The disclosure appreciates the issues created by having large numbers of relatively smaller rigid vertical elements, and improves upon '934 by proposing the use of a relatively smaller number of vertical elements attached to a garment worn by the user between body and ballistic vest. However, the issues related to garment-mounted, relatively rigid, and now relatively larger-diameter elements remain; this is a problem common to solutions that are not integrated into the protective gear itself but are attempts to solve the problem "after the fact" by means of a separate garment intended to be worn between the protective gear and the wearer's body. Again, heat loss from wearer covered with multiple layers of clothing (where prior art additional garment is worn between shirt and ballistic vest) is known to be sub-optimal at best. Thus, there remains a need for improved solutions to the cooling problem of protection garments.

Another example of prior art that is intended to address the problem is the use of a volumetric-mesh-type garment intended to be worn between the wearer's body and body armor, currently sold under the brand name Max-Dri but not disclosed in any known patent. This solution requires the use of a separate additional garment, worn between a wearer's shirt and the carrier's inner surfaces, and creates a space between wearer's body and vest that is filled in a substantially complete fashion with a mesh-type and/or volumetric-mesh-type material. However, it does not provide as much air circulation over the wearer's body as would be desired, due to lack of a way to move useful amounts of cooling air over the wearer's body.

Thus, it is clear from the foregoing partial review of prior art and other considerations that improved wearer cooling requires that the protective gear itself, rather than the clothing worn under it, be designed for improved heat dissipation (largely convective and evaporative in nature) from wearer by means of providing for ways to achieve increased amount of ambient air flow over the wearer's torso for purposes of cooling. It also becomes clear that it is further desirable that the protective equipment be moved away from immediate contact with the wearer's body and/or the clothes thereon, to enable this.

Another example of a prior art system for general application to preventing heat injury to personnel wearing body armor that uses this (armor-mounted system) approach has been disclosed by J. Shelton in U.S. Pat. No. 9,772,166. The system proposed therein consists of an additional panel emplaced between wearer and a ballistic panel carrier inner surface, with the additional panel having numerous vertical grooves and perforations intended to allow air circulation through said grooves and perforations in the panel, when said panel is placed between the inner surface of panel carrier and the wearer's clothing. Such panels are currently sold under brand name TACVENT, are corrugated-sheet-like in shape, and generally are intended to be attached to one or both ballistic vest interior surfaces by various means.

This type of prior art system in practice contains a relatively large (more than 7) number of vertical areas of the article that are in contact with wearer's clothing (per side), and those areas create relatively narrow channels for air movement. The cross-section of these channels, in sum, is a relatively small area; thus, the amount of cooling air movement through such channels per unit of time is quite limited due to their low cross-sectional area. As a result, the cooling effect is expected to be much less than that desired based on mathematical modeling data disclosed below for estimating cooling ability of systems intended for protective gear wearer thermal stress reduction. It is well known to the art of heat transfer engineering that effective air cooling at relatively low temperature differential between air and objects whose surfaces are to be cooled requires larger volumes of moving air. At relatively low-pressure differential between inlet and outlet, that in turn necessitates a high cross-sectional area for air flow, something this prior art fails to provide. Further, the design is mostly intended for use with soft body armor, or with soft body armor that has had additional hard armor elements added to it externally. Thus, while the system is useful, it is desired that much greater amount of cooling air flow be possible than this prior art system provides, applicable to hard body armor.

Another prior art invention is disclosed by C. Crye et al. in U.S. Pat. No. 6,892,392 and is directed towards body armor systems that are required to contain both standalone soft armor panels that are not part of a combination of panels that are used in a superimposed fashion with hard armor panels, and separate hard armor panels. It describes upwardly extending air channels created by pads or spacers located between the wearer and body armor. This makes the '392 system more effective than teachings in '166. However, '392 requires the use of a system that contains both standalone soft ballistic panels and hard ballistic panels that are located on the exterior of the protective garment. In contradistinction, the instant disclosure is directed to systems substantially lacking in standalone soft armor; the only soft armor contemplated by the instant invention is used as part of "in conjunction" hard body armor ballistic panels and not alone. The exclusion of standalone soft armor panels and/or their replacement with hard armor panels results in either significantly improved ballistic resistance of the system's ballistic panels, lower system weight, or both in the practice of the instant invention. Further, prior art fails to teach the optimal spacer arrangements and dimensions, and air channel dimensions, that would result in further significant improvements to heat transfer performance of such a garment during use. Further yet, in its non-limiting drawings, prior art shows an arrangement of spacers/pads that is outside the scope of the instant invention, as described in greater detail herein below. Further yet, the prior art teaches the required use of additional plastic elements in conjunction with the soft armor elements in order to ensure they are located properly and do not sag, bunch, etc.; this adds, necessarily, further weight and cost to the prior art's embodiments that are advantageously avoided in the practice of the instant invention.

In light of the above, there remains a significant need for a way to improve further yet the effect of user cooling, by means of creating suitable relatively larger and more effective cooling air flow over the areas of torso covered by armor for wearers of hard ballistic protection systems, and other protective gear systems (e.g., athletic). It needs to be relatively low cost, highly effective, light, and not dependent on outside power/cooling sources.

Because of well-known weight-related issues, it is impractical for means of cooling the protective equipment wearer to be of a variety that is powered using pumps, fans, and other powered and/or moving parts; therefore, devices employing such, as well as liquid-based cooling systems, are not part of the instant invention and are not considered relevant to it as prior art.

Further, it is well known that existing protective clothing that conforms closely to wearer's body results in poor cooling despite all existing attempts to improve the situation in prior art. Also, clothing that conforms closely to user's shape is difficult to make so that it can fit wide ranges of both male and female users properly.

Existing athletic protective equipment's remarkably poor performance in terms of protection against traumatic heart injury by objects has been widely reported and is thus well known to the art from animal models that show commercially available products fail to exhibit useful protective qualities with respect to protection from commotio cordis. See Weinstock J, Maron B J, Song C, Mane P P, Estes NAM III, Link MS. Failure of commercially available chest wall protectors to prevent sudden cardiac death induced by chest wall blows in an experimental model of commotio cordis. Pediatrics 2006; 117(4):e656-e662. One set of examples illustrating these failures in actual practice has been reported for hockey players and thus it is clear that the animal models are sufficiently representative of the actual situation that obtains at this time. See Kaplan J A, Karofsky P S, Volturo G A. Commotio cordis in two amateur ice hockey players despite the use of commercial chest protectors: case reports. J. Trauma 1993; 34:151-3. A discussion of various sports with high incidence of commotio cordis has also been reported. See Maron B J, Gohman T E, Kyle S B, Estes N A M III, Link M S. Clinical profile and spectrum of commotio cordis. JAMA 2002; 287:1142-6.

The factor that essentially all prior art protective equipment having poor results in protection against traumatic heart injuries in general had in common was a lack of a means to prevent the transmission of impact energy from said protective device to the precordium and nearby regions. In light of the above, it is desired that athletic protective devices provide a means to prevent such transmission and therefore prevent or at least greatly reduce traumatic heart injuries, including but not limited to commotio cordis, myocardial contusion, and other types of blunt cardiac and other trauma. Due to widely known problem of athlete fatalities due to heat-related-trauma, it is critical that protective devices provide for improved cooling to prevent thermal injury of athletes. See Boden B P, Breit I, Beachler J A, Williams A, Mueller F O. Fatalities in High School and College Football Players. Am. J. Sports Med. 2013; 41:1108-1116. It is further critical that the impact protection and the cooling features exist at the same time in the same article of safety equipment intended for use in the context of employment by athlete(s).

Thus, it is clear there exists a significant need for a way to improve the effect of user cooling, by means of creating suitable relatively larger and more effective cooling air flow over the areas of torso covered by protective gear, especially for wearers of assorted athletic impact protection systems located in the general precordium region of the wearer's thorax. It needs to be relatively low cost, highly effective, light, and not dependent on outside power/cooling sources. It should advantageously be physically robust and sufficiently comfortable to wear. It should further at least greatly reduce, and preferably eliminate, the possibility of impact to the precordium of athlete(s) during their activities.

By way of illustration, several examples of prior art athletic protective gear are discussed below in terms of their deficiencies related to improving cooling air flow over the thoracic region of the athlete using same, and in terms of deficiencies in prevention of impact energy transmission through the prior art devices in the precordium region.

U.S. Pat. No. 6,182,299 to Chen discloses a design for a baseball chest protector device. It is generally a good representation of typical protective equipment employed for protection of baseball players in certain positions, namely catchers. As can be seen, the inner surface of the device is intended to largely conform to the body of the wearer, and its wearer-facing surface, when the device is used, will be largely in immediate contact with the wearer's clothing. Thus, the device is going to suffer from wearer overheating at high temperatures and/or high humidity conditions, and further, the device lacks suitable means of preventing propagation of impact energy to precordium region through the foam-like material of the prior art device. Thus, the need for devices giving generally similar type of protection but having a means to enable air cooling of wearer's frontal torso area and a means to prevent impacts to precordium region remains unaddressed by prior art.

A generally similar type of construction with similar advantages and disadvantages is also disclosed in U.S. Pat. Nos. 6,678,899 and 6,826,786 to Fiorini et al.; it is described as specifically form-fitting, which of necessity results in the parts of wearer anatomy overlaid by the device losing their ability to cool the athlete. An important part of this prior art elaborates further on the aspects of this prior art to ensure it is placed in immediate contact with its wearer. Thus, the need for devices giving generally similar type of protection but having a means to enable air cooling of wearer's frontal torso area and a means to prevent impacts to precordium region remains unaddressed by prior art.

US application 2006/0005306A1 to Call et al. discloses a design for trying to protect wearers from commotio cordis that comprises a snug fitting garment that employs a viscoelastic polymer to reduce blunt trauma to precordial region by objects during athletic activities and the like. However, this device leads to elevated risk of athletes suffering from heat-induced trauma, because it prevents heat loss from large parts of the wearer's torso. Thus, the need for devices giving generally similar type of protection but having a means to enable air cooling of wearer's frontal torso area remains unaddressed by prior art.

U.S. Pat. No. 8,959,671 to Mandak discloses an apparatus and methods for using a device for prevention of commotio cordis. This prior art contains a good discussion of the reasons for why most of existing protective equipment does not provide adequate prevention of this type of injury. However, this prior art is quite inconvenient in practice, and fails to provide effective cooling by way of a directional stream of air to the areas being protected. Thus, the need for improved devices remains.

U.S. Pat. No. 7,735,161 to Purington discloses a chest protector device that includes a plate equipped with supporting members, sometimes also termed "shock absorbing members" that are attached thereto. Selected preferred embodiments of these are depicted in prior art FIG. 3A and FIG. 5A. One of the prior art's deficiencies is the fact that it is mostly designed for a relatively low energy threat, namely a baseball that travels at about 40 mph (i.e., 40 miles per hour), although higher energy impacts are contemplated. As is well known to the art, impact energy of balls increases in proportion to the square of their velocity; thus, baseballs at 80 mph and greater velocities that are a common threat possess four times more, or even greater, energy vs. those at 40 mph. When tested against higher velocity baseballs (e.g., about 70 mph), the designs of this invention provided a comparatively poor level of impact protection as evidenced by severe damage to clay witness disc when a "fair" hit was registered upon protective systems of the prior art invention in experiments of the type discussed in the example section below. This prior art does teach the general principle of using stronger plates than specified for protection against higher energy impacts. However, in certain cases, it becomes important to have a shorter distance between the spacers and a larger plate, making it advantageous to use three or more such spacers to better fit wearer anatomy, and prior art fails to teach the use of more than two spacers (termed "supporting members" in prior art). Importantly, prior art invention is significantly inferior to the instant invention in wearer cooling capability and thus in prevention of thermal injury to wearer. This occurs because prior art specifically teaches that the spacer equivalents described therein variously, including as "shock absorbing members" and the like, are extended no further than the top and/or bottom of the protective plate. What this means in practice is that the cooling airflow that is possible to achieve is significantly reduced, since the vertical extent of the air space required by prior art is thereby much lower than that taught in the instant invention. It has been found that for optimal wearer cooling that is a critical part of the instant invention, the height of the air space should be as great as practical, and at all times appreciably greater than the vertical extent of the rigid protective plate in the applications relevant to prior art's disclosure. Further, the prior art embodiments suffer from additional problems. Such protective devices need to be relatively lightweight, yet, in practice and in accordance with prior art teachings, strong enough to prevent impact to the area being protected. Thus, for protection against high-speed balls, the increased weight per unit area of the protective plate becomes an important factor. The designer then has a choice between relatively heavy weight and a larger than needed protected area, which is not optimal and severely impacts athletic performance, and a more practical weight and a relatively smaller area covering the precordium, which is generally what would be chosen. However, such a design suffers from very poor heat dissipation, because the air space's vertical extent as taught in the prior at is, in such situations, excessively short. Thus, in all cases, prior art fails to teach optimal wearer cooling techniques by means of stack effect induced air flow in combination with improved protection from impacts.

U.S. Pat. No. 7,093,301 to Moore teaches a vest for use in equestrian protection, possessing a plurality of panels. This prior art again teaches the use of vests containing a plurality of protective panels that are placed in immediate contact with the wearer's clothing over their torso and nearby areas and provides for a vest that is highly flexible. This prior art rails to provide for a way to achieve highly effective cooling of the wearer's torso.

Further, a variety of standards have been proposed, in particular for baseball and lacrosse, resulting in the issue of a relevant established standard, incorporated herein by reference in its entirety (known as NOCSAE standard). See STANDARD TEST METHOD AND PERFORMANCE SPECIFICATION USED IN EVALUATING THE PERFORMANCE CHARACTERISTICS OF PROTECTORS FOR COMMOTIO CORDIS NOCSAE DOC (ND) 200-19. The standard is limited to protection against commotio cordis and does not attempt to address other severe thoracic region injury types to players. Further, equipment meeting this standard is still not sufficiently protective, since it is only tested against ball impacts at a maximum of 50 mph, whereas it is well known to the art that baseball impacts at much higher energy levels (90+ mph) or even as much as 100 mph are a known hazard.

It is therefore a primary object of the present invention to provide cooling and/or air flow to protective equipment and/or gear.

It is a further object of the present invention to utilize the stack effect to cause cooling associated with worn protective devices.

These and other objects of the present invention will become apparent to those skilled in the art as the description thereof proceeds.

SUMMARY OF THE INVENTION

The present invention is directed to a system for enabling airflow and enhanced cooling effects for use as part of protective clothing with rigid plate(s). The equipment may be worn, and include a carrier and/or compartment located along a side of a torso of a wearer. At least one rigid protective plate may be supported by or in the compartment. At least one, or more preferably, at least two vertical and/or angled substantially continuous spacing elements may be positioned between an interior surface of the rigid protective plate and the torso. The spacing element(s) form an air gap between the interior surface of the carrier and the wearer and at least one adjacent vertical spacing element. Each of the vertical spacing elements may possess a narrow contact surface between 1-5 cm directed towards the wearer's torso. Preferably, the number of vertical spacing elements numbers between two and seven per compartment and/or plate, preferably including one at the right and left of the center of the torso. When multiple compartments used, spacing elements may be arranged relative the torso and/or the compartments. Preferably, there are no more than six air gaps per compartment. Preferably, at least two of the vertical spacing elements are set in parallel with one another.

Straps may be used and coupled to the carrier. The carrier may include an outer foam layer set outward of the compartment, such as to muffle incoming ballistic or blunt impacts. The vertical spacing elements may be made of cylindrical or hemicylindrical foam bodies, and may be laterally covered by mesh. Spacing elements may alternatively shaped as trapezoidal elements with a small of two parallel sides facing the wearer's torso. Spacing elements may be comprised of numerous bodies held together in place by a cover, and/or may be rectangular cuboids.

In some embodiments, four compartments may be arranged around the torso, each compartment receiving at least one rigid panel. Vertical spacing elements may couple two adjacent compartments. Four vertical spacing elements may be associated with four total compartments, and may be laterally covered by mesh.

Angled spacing elements may be stacked above each of the vertical spacing elements and laterally covered by mesh. When using prior art gear, angled spacing elements may be placed under and/or on top of a plate. Angled spacing elements are preferably angled toward the thorax to produce a directed stack effect.

Preferably, when used on front and back, a second carrier with independent spacing elements may be used. Two straps, such as shoulder straps, may be used to join the carriers into one piece of gear. Preferably, two vertical spacing elements may be arranged vertically relative one another with a horizontal air gap set therebetween.

In some embodiments, vertical spacing elements may be directly affixed to the rigid protective plate, optionally via hook and loop fasteners. Each of the vertical spacing elements may be associated with a particular rigid protective plate, and may include a vertical cylindrical body along left and right ends of the plate and a hemicylindrical plate with a flat end directed towards said rigid protective plate.

The present invention is also directed to a method of creating a cooling air flow in the space between the wearer and the interior surface of the system. A protective equipment item may be located on the wearer's torso, front, and/or back, and/or sides to provide wearer protection from ballistic and/or blunt impacts, etc. A plurality of vertical spacing elements may be arranged to cause a "stack effect" of induced air flow, whereby the airflow passing through the space(s) is/are channeled by one of the vertical elements, the airflow channel defined by interior surface of the compartment and the wearer, whereby the top and bottom of the channel being open to ambient air. A method of cooling air flow in the space between the wearer and the interior surface of the system may include locating protective equipment on the wearer's torso to provide wearer protection from ballistic and/or blunt impacts, including one carrier set dorsally and a second carrier set frontally. Vertical spacing elements may be arranged to cause a "stack effect" induced air flow, whereby the airflow passing through the space(s) is/are channeled by one of the vertical elements, the airflow channel defined by interior surface of the compartment and the wearer, whereby the top and bottom of the channel being open to ambient air.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

Figure 1:
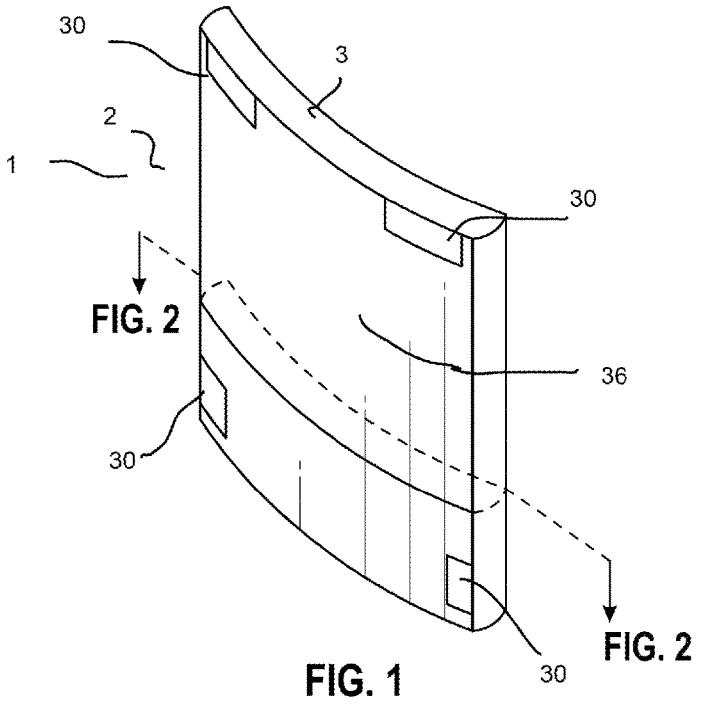
FIG. 1 PRIOR ART
FIG. 1 illustrates a front perspective view of a prior art ballistic protector.

Ballistic and athletic personal protective equipment utilizing rigid panel(s) featuring designs for improved cooling employing "stack effect" airflow in combination with optimized wearer contact surface geometry.

The systems further provide improved levels of protection from impact and from ballistic threats in various applications by replacing soft protective materials with rigid ones.

Protection against impact-induced cardiac trauma, including commotio cordis, is improved in athletic applications compared to existing systems. Athletic performance is improved through a combination of lighter protective equipment and improved wearer cooling effects. Human factor performance and protection against ballistic threats are improved by enabling lighter body armor systems with improved cooling effects, as well as easier and wider use of higher rated rigid protective ballistic panels.

Soft protective sports gear for use on and/or around the torso, and soft ballistic armor are widely used by, among others, sports participants, and law enforcement and security personnel. Soft protective sports gear and padding (as discussed earlier) provide comparatively poor protection against an especially dangerous and often fatal injury to the heart, commotio cordis, as well as more generally against other impact injury. Proper placement of rigid protective elements in sports protective gear is known to be effective for protecting against these types of injuries under certain conditions. However, when such elements are backed by plain foam-like materials in contact with wearer, they are highly uncomfortable due to loss of cooling for the athlete.

Existing NOCSAE standard testing has a maximum baseball velocity limit of 50 mph (about 37 J kinetic energy). It is known, however, that high school pitchers can reach up to 85 mph (about 103-108 J energy) and collegiate ones as much as 95 mph (about 134 J energy). Clearly, the existing improved NOCSAE-compliant equipment is still not sufficiently protective against kinetic energy levels that are more than 3.6 times higher than test limits. Much more protective equipment is needed.

Soft ballistic armor is not effective against many rifle-cartridge-type projectiles and certain other projectiles that have become a common threat to security personnel, police officers, and others; the use of such projectiles encompasses cases including but not limited to several recent high-profile incidents and its frequency may increase in the future. Soft ballistic armor alone is also generally not sufficiently effective against stabbing threats. These threats have had to be addressed by addition of suitable additional modules over or under existing soft ballistic vests, such as "rifle plates" and others; these and assorted other add-on devices to address the threat of stabbing instruments are well known to the art. However, "after the fact" add-ons are obviously not as convenient, not as light, and not as rapidly available in many cases as the simpler hard armor that protects against all these threats by itself, without complications and additional costs.

Another aspect of the problems faced by wearers of ballistic protection products is that often they lack sufficient time due to exigent circumstances to add and/or properly install the necessary additional modules, or to change over from soft to hard armor. Many users currently wear soft ballistic armor on a day-to-day basis because it often leads to less heat stress on the wearer, and switch to hard ballistic armor (with its associated increased risk of overheating) only for specific and relatively more rare situations where they expect higher threat levels to be encountered. However, this is only effective when a threat can be anticipated well in advance, and unanticipated threats that are more frequent leave a wearer inadequately protected, resulting in avoidable cases of injury and/or death. If hard ballistic armor was available that had significantly better cooling than exists with current and prior art, wearers could use it full time instead of occasionally. Thus, they would be both being better protected at all times, and (in some cases) enjoying significant cost savings, since only one set of ballistic armor would then require instead of two, where a separate soft ballistic armor set and a separate hard ballistic armor set are employed for each user.

Further, for applications where lower-cost ballistic protection of relatively light weight is required that is still capable of dealing with most handgun cartridge type projectiles, the use of rigid Level IIIA plates that protect many of the critical organs in the thoracic region of the wearer can be a potential solution as well. Despite the potential interest in these due to relatively light weight and comparatively low thickness, they still suffer from the same heat-related discomfort issues as other hard body armor systems due to thermal insulation properties shared by all hard armor plates, although they are not as bulky as plates intended for higher threat levels. The use of these lower rated hard plates in accordance with the instant invention can enable creation of alternatives to soft Level IIA, II and IIIA armor that is of significant utility in areas where some combination of high temperatures, high humidity, and high intensity of wearer activity render the use of traditional soft armor difficult and/or undesirable by users due to well-known risks associated with overheating. Thus, improved varieties of "hard" body armor systems are needed.

Therefore, one set of the preferred embodiments of the instant invention is directed towards hard ballistic armor for protection against various threats, comprising (per side of wearer) at least the following:

- at least one carrier device for containing the rigid ("hard") ballistic panel(s) (commonly termed "plate carrier")
- at least one rigid panel intended for protection against ballistic threats, preferably at least meeting NIJ standard Level IIIA (or similar) or possessing even higher protection level (Level III, IV, similar, or higher)
- an optional soft ballistic armor layer located between the rigid ballistic panel and inner layer of the plate carrier device; this is used when the rigid panels being employed are intended for use in conjunction with such additional layer to achieve desired NIJ ratings and is, for the purposes of instant disclosure, a part of the rigid ballistic panel
- additional element(s) for locating the panel(s) that are placed inside the carrier on the wearer's body (e.g., straps, belts, buckles, fasteners, etc.) that are known to the art
- at least one space for air flow per side of wearer that is described in detail herein below created by means of "spacers" of the instant invention whose dimensional limits and configuration are described in the instant disclosure.

Additional optional elements may also be present and are well within the scope of the instant invention.

When a hard ballistic panel is used in conjunction with a soft armor layer (as required by manufacturer to meet relevant NIJ standard requirements), the combination will be termed "hard armor panel" and treated as a single entity for the purposes of the instant disclosure. One preferred embodiment of the instant invention contains either only a single, frontal or dorsal, hard ballistic armor panel, or, even more preferably, of two such panels, one frontal and one dorsal; a plurality of such panels may also be advantageously used (e.g., side panels can be added). The preferred embodiment optionally contains, or has attached thereto in various ways known to the art, additional elements on the plate carrier that are well known to the art, such as straps, snaps, openings, compartments, etc., intended for addition of various accessories, devices, armament, supplies, and equipment, or for moving the user conveniently (grab handles); additional insignia, objects of significance to wearer, etc. may also be attached to the carrier in various ways known to the art. The instant invention's plate carrier is designed to create (in addition to certain other effects whose presence will be obvious to one skilled in the art of heat exchange equipment design) a "stack effect" to cool the wearer in an effective manner, believed to be superior to the effects produced by prior art, by providing for sufficient airflow in an ascending direction between the wearer's body and/or clothing, and the inner surface of the plate carrier, thus cooling the wearer effectively without employing external power sources or complex devices, and without adding significant weight or cost to the armor system. All of these, separately and in various combinations, are considerations whose importance is well appreciated by those skilled in the art of creating personal protective equipment for tactical uses.

The cooling system elements contemplated herein are intended to be mounted to (or incorporated into) the inner surface of a hard armor plate carrier; design elements of other parts of carrier and panels therein are not critical. In terms of methods of cooling the wearer, it is desired that a flow of ambient air be directed upwards across the thoracic region of the wearer, preferably both frontally and dorsally. This is achieved by having at least 2, but no more than 7, vertical "spacer" elements per wearer's side that are attached to (or are part of) the interior surface of the plate carrier, said spacers composed of sufficiently elastic and lightweight materials (e.g. foam, mesh, etc.) located vertically along interior surface of the armor panel's carrier, with at least 2 of said vertical elements located individually and separately along each of the 2 outer vertical or approximately vertical edges of each panel's compartment. The "thickness" (dimension perpendicular to the general plane of the armor panel carrier) of the vertical elements should be between about 2 cm and about 7 cm. The "width" of these elements (dimension along a horizontal plane) should be between about 1 cm and about 5 cm, but preferably not to exceed about 3 cm, the measurement being taken at the surface of contact with wearer and/or wearer's garments. The total surface coverage by these elements as a fraction of the total inner surface area of the plate carrier should not exceed about 40%, and preferably not exceed about 20%.

Frontal and dorsal plate carriers may have different numbers and dimensions of these vertical "spacer" elements. The vertical elements may be formed by any means known to the art of body armor plate carrier equipment fabrication. An important aspect of the instant invention is that the top and bottom parts of the interior surface of the plate carrier, and the parts of the plate carrier that position the frontal and dorsal plates on the wearer, do not excessively impede the ascending airflow through the interior of the device (i.e. the space between the inner surface of plate carrier and wearer's body and/or clothing), airflow across its intake at the bottom of the plate carrier, and its hot air exhaust at the top of the plate carrier. It is preferred that the vertical elements be substantially continuous, so that at least about 75% of the length of the vertical extent of the plate carrier is uninterrupted, and preferably at least about 90% or greater. In order to optimize the stack effect induced cooling effectiveness, it is desirable that the spacers' vertical dimension be as large as practical consistent with overall system usability. The geometry and thickness of these spacers may be varied along their length within limits set forth in the instant document, so as to fit various individual body types and sizes for male and female users, making the devices of the instant invention more widely usable.

It is important to note that the shapes, numbers of features, and configurations of features that define the spaces and the spacers forming same can be varied within the limits set forth herein to achieve a variety of effects to optimize the specific product's performance. For example, spacers can be designed to optimize the use of plate carriers with frontal female anatomy of various sizes. Further, depending on the intended weight of overall plate carrier and all devices and objects attached thereto and/or carried therein (including the ballistic panel(s), supplies, etc.) the spacers' numbers, spacing, geometry, materials of construction, cross-section, and area in contact with wearer and/or wearer clothing can be varied within the limits taught in the instant disclosure for each of the ballistic panels employed. The spacers may be optionally variously mounted to existing plate carriers, such as via removable extensions to a plate carrier's shoulder pads. In a different way to describe some elements of the instant invention and its difference from prior art practice, a number of distinctions between commonly available plate carriers and those of the instant invention can be emphasized for better understanding. In many plate carriers that are in common use (prior art), the entire inner surface is covered by a more or less homogeneous thickness of foam and/or mesh material of various compositions, so that the rigid ballistic panel does not cause pain and injury to wearer. In prior art embodiments, the interior surface of the plate carrier is in relatively close, or more frequently in immediate contact with, the wearer's clothing to the extent of at least 50%, and often over 60%, of the area of the inner surface of plate carrier is in such contact. In accordance with the instant invention, most of this material would be thought of as being removed in contradistinction with current practice, leaving the foam and/or mesh only in areas that form the vertical spacer elements of the instant invention, and thus forming the large air space(s) with useful cross-section area for effective air flow cooling to occur. Contact between the wearer and inner surface of the plate carrier is prevented, and the space(s) of the instant invention created, by having the vertical spacer elements be sufficiently sized to prevent wearer contact with the parts of the inner surface of the plate carrier that is not a part of the vertical elements. Stack effect enables effective ascending airflow through the space(s) to provide a high degree of cooling to wearer.

To better understand the scope and innovative elements of the instant invention, while a simpler method for creating the necessary space(s) between the inner surface of the plate carrier and the wearer is via addition of "spacers" (also termed "vertical elements") to the plate carrier on its interior surface(s), that is merely a preferred embodiment in terms of lower costs and use of existing armor panels with no modifications. In practice, the specific means employed for creating the space between wearer and plate carrier's interior surface(s) is not critical, and could be achieved also by way of adding spacer elements to the inner surface of hard armor panel(s) themselves along its/their vertical sides and optionally other parts of wearer-facing panel surface. Such a design would also be within the scope of the instant invention, although it may result in more costly panels and more complex (and thus costly) plate carrier designs. The creation of space(s) for cooling ascending airflow by means of devices that are part of the rigid-panel-containing protective system is a critical novel element of the design of the instant invention, while the means of space creation are not critical (as long as they comply with dimensions taught herein) and can be any that are known to the art; it is obvious to those skilled in the art that such means as are lower in cost and/or weight and/or complexity of creation are preferred. Another example of a useful way of creating spacers of the instant invention is to have them made as extensions of, or parts of, the shoulder straps/pads of plate carriers. This way, many existing plate carriers can be "upgraded" to this technology without being replaced entirely, but merely by replacing existing shoulder pads with those embodying the instant invention. Shoulder pads may be made with extensions made to work as spacers and extending down the inner faces of the plate carriers. This would be used when prior art ballistic plates or the carrier(s) articles must be used due to budget and/or regulatory reasons, and would serve as a special aftermarket shoulder pad attachment. Such design may be limited to two spacers per wearer side, for minimal effect at low cost. With heavier weights on plate & carrier combination, additional spacers may be needed to prevent development of excess pressure along the spacers' lines of contact with the wearer.

One key element of the instant invention is, for each individual combination of plate carrier part(s) and hard ballistic panel(s) employed, the creation of at least one, or a small (preferably no more than 3, and no more than 6) number of spaces per side (front, back, right side, left side) of wearer. Each of these spaces extends largely vertically and is open at the top and at the bottom, bounded on right side and left side by its corresponding vertical "spacer" elements, said elements extending from approximately the bottom of the inner surface of the plate carrier upwards, to at least approximately the top of the inner surface of the plate carrier. The space extends in the horizontal plane, uninterrupted, between the wearer and the inner surface of the plate carrier. It is important to note that the space(s) is/are substantially continuous and substantially uninterrupted to enable optimal air flow.

Another critical element of the instant invention's teaching is that the "widths" of spacer materials and total surface area of same in contact with the wearer needs to be carefully selected in accordance with the information provided in the instant disclosure. Firstly, it is required that the sum of all spacer surface areas in contact with wearer be relatively smaller than that taught in prior art explicitly or by example. This results in greater cross-section area of openings for much greater air flow than possible with prior art's techniques. Secondly, the surface area of spacers in contact with wearer needs to be divided among the spacers in specific ways described herein for optimal wearer cooling. It is important that the width of each individual spacer at the surface in contact with the wearer be relatively small, preferably about 1-3 cm, although the spacer may be somewhat wider in the area where it is connected to the interior surface of the plate carrier for reasons of potential spacer structural integrity improvement. In other words, spacer cross-section may be of approximately trapezoidal or hemispherical shape, as well as rectangular or parallelogram-like.

This is an important feature of the instant invention that improves the cooling function. By example, two vertical rectangular spacers, each about 7 cm wide at location of contact with wearer, one on each side of a plate carrier, provide cooling that is significantly inferior to 7 vertical spacers, each 2 cm wide, equally spaced, even though the total surface area in contact with the wearer is identical. This is because with wide spacers as shown in prior art, the evaporation of perspiration from the areas of the wearer's body located near the center regions of the spacers is relatively poor, the perspiration needing to traverse at least about 3.5 cm or more through the spacer. However, with narrower spacer contact areas of the instant disclosure, the perspiration from areas occluded by spacers traverses a far shorter distance; thus, the rate of mass transport is far greater, and the cooling effect is thereby significantly improved. This novel element of construction has not yet been taught in prior art. The especially advantageous effect of combining maximized stack effect airflow and optimal spacer (and cooling space) geometries has not heretofore been taught and is a critical feature of this invention's innovative aspects.

In general, the number and total surface area of spacers per each wearer side in direct contact with wearer (via clothing or directly) should be as reasonably small as possible consistent with wearer comfort. When rigid ballistic panels of larger sizes and heavier weights are employed, it is necessary to increase the spacer surface area in contact appropriately, so as to avoid excessive pressure on the wearer at the locations where direct contact of spacers is made with wearer's body and/or clothing thereof. Similarly, when the total weight of the entire vest with ballistic panel(s) therein and all of the items, accessories, equipment, supplies, etc. attached thereto is increased, a similar increase in spacer contact area becomes necessary in the interests of wearer comfort. When this is done, it is important that the width of each individual spacer is not increased beyond the specifications of the instant disclosure. Instead, a larger number of spacers should be used (not to exceed 7 per side). Further, the distance between the spacers' areas in contact with the wearer and/or clothing thereof should be maximized, but should be at least about 1 cm and preferably about 2 cm or greater. This is important so that the spaces of the instant invention intended for ascending cooling airflow are not made too narrow, and thus impede the airflow function of the spaces excessively. An important aspect of the function of the instant invention is the transport of evaporated perspiration via air circulation in aid of wearer cooling to provide greater wearer comfort in an innovative and highly effective fashion.

To better understand the important distinctions between the instant invention and '166, the instant invention teaches an approach that requires non-obvious omission of some critical elements of invention taught in '166. Claim 1 therein teaches the requirement for having "a first plurality of vent spaces where each vent space in said first plurality of vent spaces is defined in a void between the vest, one of said valleys, and between two of said sidewalls". In the practice of the instant invention, it is important not to create this prior-art-required void, since it does not contribute, and may impede, the upward flow of air between wearer and inner surface of plate carrier, and thus, in the instant invention, does not enhance wearer cooling. In other words. '166 teaches the required use of two sets of vent spaces ("voids"), one set between the prior art device and vest, and another set between the device and wearer. The instant invention teaches that in contradiction to prior art, only one set of spaces ("voids"), located only between wearer and vest, is required, and teaches against creating the other set. Further, the instant invention also teaches that only a single space per side, or at most a small number of spaces, may be used and not a large plurality as taught by '166. To reiterate, no other space or set of spaces is needed in the instant invention aside from that/those between wearer and plate carrier; the deletion of '166 required features is required, and is advantageous in the practice of the instant invention, making the device(s) taught herein more effective at cooling, lighter, cheaper, and easier to make. The deletion of heretofore required features is part of the novelty of the instant invention. Another deletion of required elements of prior art that is an important element of the instant invention is the elimination of the features taught in Claim 2 of '166, namely the existence of the plurality of vent spaces between vest and panel taught by prior art. The instant invention teaches that no panel needs to be present at all in the space between the plate carrier's inner surface and wearer, and thus there cannot be any spaces described in '166 Claim 2 in the instant invention. Yet further, the instant invention teaches a required absence of a separate panel that is the object of invention in '166.

For the purposes of this invention, the terms "carrier" and "plate carrier" refer to any device, combination of devices, article(s) of clothing, or equipment that is/are capable of supporting, carrying, containing, or having attached thereto in any way, at least one rigid ballistic panel of a size that is in commercial, law enforcement, or military use. While generally most plate carriers enclose a ballistic panel substantially or even fully, that is merely a convenient technique and should not be read to limit the scope of the instant invention. Articles that can embody the instant invention are enumerated in the disclosure to include (but are not limited to) such devices as backpacks and the like, but also can include any articles of clothing and/or accessories of clothing, gear, that may be worn on, or about, the torso.

The creation of the 3D geometry of the instant invention between wearer and combination of carrier and ballistic panel may be done in any suitable way, specifically including (without limitations) the variation wherein the spacers of the instant invention are attached to, or are part of, the ballistic panel and not the carrier. Further, such a spacer-equipped ballistic panel may employ any suitable article of clothing as its carrier, and not just traditional plate carrier(s). As non-limiting examples, a ballistic panel equipped with spacers may be suitably attached to the interior of a shirt-type garment, or a T-shirt type garment, or suitably attached to suspenders worn by its user, or any combination of these. The means for attaching such a panel to its carrier are not critical, so long as the space intended for the cooling of wearer is not occluded to the point where the cooling function ceases, and as long as the panel is successfully located over the areas to be protected. Similar applications to athletic protective gear are also part of the instant invention, so (for example) a suitable protective plate and spacers attached thereto could be attached to the interior of various garments commonly worn by participants of athletic competitions, training, and the like, located over appropriate parts of the torso to be protected.

Another set of preferred embodiments of the instant invention is directed towards athletic protective device for baseball catchers, sometimes termed a "chest protector", comprising at least the following:

- at least one panel composed of suitable material(s) commonly used in making baseball catcher chest protectors containing the rigid ("hard") panel(s) described below that is located over the precordium area and covers it in its entirety, and preferably further covers its immediate surrounding area to an extent of at least 5 cm in each direction as well; the panel(s) cover(s) the areas known to the art as those typically covered by such protective devices
- at least one rigid panel intended for protection against impact(s) and located over the precordium area and covers it in its entirety, and preferably further covers its immediate surrounding area to an extent of at least 5 cm in each direction as well, preferably at least capable of being deflected by under about 7 mm when impacted by a standard baseball traveling at about meters/second; panels possessing a higher degree of rigidity and impact resistance are preferred provided they are made of sufficiently thin and sufficiently light material(s); a single panel or a plurality of no more than 4 such panels is preferred
- an optional first soft layer of material(s) commonly used in making baseball catcher chest protectors located between the rigid panel and wearer-facing side of the protective device provided it does not make significant contact with the wearer's body and/or clothing; said distancing being enabled by spacers of the instant invention
- an optional second soft layer of material(s) commonly used in making baseball catcher chest protectors located between the rigid panel and the non-wearer-facing (outer) side of the protective device
- additional element(s) for locating the entire chest protector and its rigid panel(s) on the wearer (e.g., straps, belts, buckles, fasteners, etc.) that are known to the art
- at least one space for air flow per side of wearer that is described in detail herein below created by means of spacers described herein The materials useful for making such rigid panels are well known to the art of impact protection and include, but are not limited to, various high strength polymeric materials (e.g., polycarbonates, etc.), metals (e.g., high strength aluminum alloys such as 7075, titanium alloys, etc.) and composites.

Additional optional elements may also be present and are well within the scope of the instant invention. The cooling system elements contemplated herein are intended to be mounted to (or incorporated into) the inner surface of a chest protector type device of a type commonly employed in baseball; design elements of other parts are not critical. In terms of methods of cooling the wearer, it is desired that a flow of ambient air be directed upwards across the thoracic region of the wearer frontally by means of inducing a "stack effect". This is achieved by having at least 2, but no more than 7, vertical "spacer" elements that are attached to (or are part of) the interior surface of the chest protector, composed of sufficiently elastic and lightweight materials (e.g. foam, mesh, etc.) located vertically along interior surface of the protector, with at least 2 of said vertical elements located generally along each of the 2 outer vertical edges of the protector; however they should not be so widely placed as to prevent contact with the wearer's torso, in which case they should be positioned as far apart as practical but sufficiently close together to enable such contact, accommodating the wearer's body anatomy. The "thickness" (dimension perpendicular to the general plane of the protector) of the vertical elements should be between about 2 cm and about 20 cm. The "width" of these elements (dimension along a horizontal plane) should be between about 1 cm and about 5 cm, preferably between about 1 and about 3 cm at the area of immediate contact with wearer and/or wearer's clothing. The total surface coverage by these elements as a fraction of the total inner surface area of the chest protector should not exceed about 40%, and preferably not exceed about 20%. The vertical elements may be formed by any means known to the art of athletic protective equipment fabrication. An important aspect of the instant invention is that the top and bottom parts of the interior surface of the chest protector, and the parts of the chest protector that position it on the wearer, do not excessively impede the ascending airflow through the interior of the device (i.e., the space between the inner surface of chest protector and wearer's body and/or clothing), airflow across its intake at the bottom of the chest protector, and its hot air exhaust at the top of the same. It is preferred that the vertical elements be substantially continuous, so that at least about 55% of the length of the vertical extent of the chest protector is uninterrupted, and most preferably at least about 70% or greater. The geometry and thickness of these spacers may be varied along their length, so as to fit various individual body types (male and female) and various sizes as well. The spacers may optionally be designed to act like impact-absorbing elastic springs to prevent excess load generation and/or pressure on the wearer at lines of contact with the wearer's clothing; to that effect they may have ring-shaped and other cross-section shapes intended for, and known to the art as usable, for such purposes. The spacers may be removable, re-attachable, positionally adjustable, relocatable and may vary in geometry of cross-section along their length in order to facilitate individual fitting to the athlete's anatomy and sizes, both male and female.

In a different way to describe some elements of the instant invention and its difference from prior art practice, a distinction between commonly available chest protectors and those of the instant invention can be emphasized for better understanding. In many chest protectors that are in common use (prior art), a majority of the area of the inner (wearer-facing) surface is covered by a more or less homogeneous thickness of material. In prior art embodiments, said surface is in relatively close, or more frequently in immediate contact, with the wearer's clothing to the extent of at least 50%, and often over 60%, of the area of the inner surface of chest protector. In accordance with the instant invention, most of this material would be thought of as being removed in contradistinction with current practice, leaving the foam and/or mesh only in areas that form the vertical elements of the instant invention, and thus forming the large air space(s) with useful cross-section area for effective air flow cooling to occur. Contact between the wearer and inner surface of the chest protector is prevented, and the space(s) of the instant invention created, by having the vertical elements be sufficiently sized to prevent wearer contact with the inner surface of the chest protector that is not a part of the vertical elements. The limitations on spacer contact areas with wearer and/or wearer clothing are substantially similar to those applicable to ballistic vest designs disclosed herein.

Another set of preferred embodiments of the instant invention is directed towards protective device for equestrian sports, sometimes termed a "protective riding vest", comprising at least the following:

- at least one panel composed of suitable material(s) commonly used in making riding vests containing the rigid ("hard") panel(s) described below that is located over the torso area and covers it to a substantial degree, and preferably between 2 and 6 such panels, inclusive
- at least one, and preferably a plurality, of rigid panel(s) intended for protection against impact(s), preferably at least capable of enabling the vest containing same to meet applicable standard(s) for equestrian protective gear (such as ASTM F2681, EN 13158); 1.5 panels possessing a higher degree of rigidity and impact resistance are preferred provided they are made of sufficiently thin and sufficiently light material(s); a pair of panels (frontal and dorsal) or a plurality (e.g. frontal, dorsal, right and left) of no more than 6 such panels in total is preferred
- an optional first soft layer of material(s) commonly used in making equestrian protective vests located between the rigid panel and wearer-facing side of the protective device provided it does not make significant contact with the wearer's body and/or clothing; said distancing being enabled by spacers of the instant invention
- an optional second soft layer of material(s) commonly used in making equestrian protective vests located between the rigid panel and the non-wearer-facing side of the protective device
- additional element(s) for locating the rigid panel(s) on the wearer (e.g., straps, belts, buckles, fasteners, etc.) that are known to the art
- at least one space for air flow per side of wearer that is described in detail herein below, created by means of spacers described herein Additional optional elements may also be present and are well within the scope of the instant invention. The cooling system elements contemplated herein are intended to be mounted to (or incorporated into) the inner surface of equestrian protective vest; design elements of other parts are not critical. In terms of methods of cooling the wearer, it is desired that a flow of ambient air be directed upwards across the thoracic region of the wearer on at least one side, and preferably a plurality of sides, by means of inducing a "stack effect", This is achieved by having at least 2, but no more than 7, vertical "spacer" elements per rigid panel that are attached to (or are part of) the interior surface of the protective vest, composed of sufficiently elastic and light-weight materials (e.g., foam, mesh, etc.) located vertically along interior surface of the rigid protective panel's container, with at least 2 of said vertical elements located along each of the 2 outer vertical edges of each rigid panel's container. The "thickness" (dimension perpendicular to the general plane of the protective panel container) of the vertical elements should be between about 2 cm and about 15 cm. The "width" of these elements (dimension along a horizontal plane) should be between about 1 cm and about 5 cm, but preferably between about 1 cm and about 3 cm; the width being measured at the line of contact between spacer and wearer's clothing and/or body. The spacers(s) may have a variety of cross-sections, and they may be wider at the point of attachment to the vest, with trapezoidal, semicircular and other cross-sections. The total surface coverage by these elements as a fraction of the total inner surface area of the equestrian protective vest should not exceed about 40%, and preferably not exceed about 20% (this is measured along the plane of contact with wearer). The vertical elements may be formed by any means known to the art of athletic protective equipment fabrication. An important aspect of the instant invention is that the top and bottom parts of the interior surface of the equestrian protective vest, and the parts of the vest that position it on the wearer, do not excessively impede the ascending airflow through the interior of the device (i.e., the space between the inner surface of vest and wearer's clothing and/or body), airflow across its intake at the bottom of the vest, and its hot air exhaust at the top of the same. It is preferred that the vertical elements be substantially continuous, so that at least about 75% of the length of the vertical extent of the vest is uninterrupted, and preferably at least about 90% or greater. The geometry and thickness of these spacers may be varied along their length, so as to fit various individual body types and sizes (male and female, children, adolescents and adults). The spacers may optionally be designed to act like impact-absorbing elastic springs to prevent excess load generation and/or pressure on the wearer at lines of contact with the wearer's clothing; to that effect they may have ring-shaped and other cross-section shapes intended for, and known to the art as usable, for such purposes. The spacers may be removable, re-attachable, positionally adjustable, relocatable and may vary in geometry of cross-section along their length in order to facilitate individual fitting to the athlete (male, female, larger, smaller). The limitations on spacer contact areas with wearer and/or wearer clothing are substantially similar to those applicable to ballistic vest designs disclosed herein.

For a baseball catcher embodiment, exemplary dimensions may include two vertical spacing elements separately laterally by eight to twelve cm, with a width/diameter of hemicylindrical spacing elements being three to six cm, with a height of about thirty cm (which may be taller than a plate that may only be twenty cm tall). It is preferred in such embodiments, that the plate be positioned along the top of the spacing element with the spacers extending below the plate.

In a different way to describe some elements of the instant invention and its difference from prior art practice, a distinction between commonly available equestrian protective vests and those of the instant invention can be emphasized for better understanding. In many vests that are in common use (prior art), a majority of the area of the inner (wearer-facing) surface is covered by a more or less homogeneous thickness of material. In prior art embodiments, said surface is in relatively close, or more frequently in immediate contact, with the wearer's clothing to the extent of at least 50%, and often over 60%, of the area of the inner surface of protective vest. In accordance with the instant invention, most of this material would be thought of as being removed in contradistinction with current practice, leaving the foam and/or mesh only in areas that form the vertical elements of the instant invention, and thus forming the large air space(s) with useful cross-section area for effective air flow cooling to occur. Contact between the wearer and inner surface of the vest is prevented, and the space(s) of the instant invention created, by having the vertical elements be sufficiently sized to prevent wearer contact with the inner surface of the protective vest that is not a part of the vertical elements. It is important to note that prior art vests are generally directed by manufacturer to be worn in ways where they closely conform to the wearer's body, whereas the fit for the instant invention's vests is different to enable cooling. In the practice of the instant invention, only the vertical elements are in intimate contact with the wearer's clothing and/or body, while the rigid protective panels and optional elements are displaced away from the body, creating the spaces of the instant invention that enable cooling airflow across user's torso. For example, a vest may have a frontal and a dorsal rigid section(s), each of these sections with preferably 2-3 vertical elements of appropriate size and location. Alternatively, it may contain four such sections placed around the torso of the wearer, namely frontal, dorsal, left and right, with each of the side sections preferably having 2 vertical elements, preferably at the vertical outer edge of each panel. As part of the instant invention, a vertical element may also be "shared" between two adjacent panels, so that, for example, a single vertical element may be used for displacing both a frontal and a side panel away from the wearer.

Explanation of the Methods of Cooling Achieved by the Systems Disclosed.

The main method of cooling the wearer of protective equipment by innovative means of the inventive improvements disclosed herein consists of allowing, and/or creating, useful amounts of cooling airflow over the wearer's torso area (frontal, dorsal, or both simultaneously, and/or over additional areas, depending on areas that it is desired to protect using the teachings of the instant disclosure) in a generally ascending vertical direction with the goal of achieving a highly efficient cooling effect. The air flow is created without resorting to forced air circulation, external power sources, and the like, which is an important element of the several advantages of the instant invention. One element of this is a creation of what is commonly termed by those skilled in the art of heat transfer engineering as a "stack effect". The volume of the cooling ambient air that should flow through the space(s) between the wearer and the interior surface of the carrier containing a rigid protective plate (regardless of specific application) is approximately calculated by the "stack effect" formula below.

$$Q = CA\sqrt{2gh\frac{T_i - T_0}{T_i}}$$

Where:

Q=volume of cooling air, in cubic meters per second

C=correction coefficient, approximately 0.65

A=total sum of cross-section area of the opening(s), which is/are bounded by vertical elements (spacers) located on the interior of plate carrier on two sides, by the plate carrier's inner surface on the third side, and by the wearer on the fourth side; expressed in square meters g=gravitational constant, 9.81 meters per second squared h=height of continuous space bounded by the vertical elements (spacers), in meters (typically about 0.3-0.9 meters)

Ti=temperature of exhaust air above the top of the opening (s), in degrees K

To=temperature of intake air below the bottom of the opening(s), in degrees K

This air volume should be calculated separately for each panel employed, and adjusted for heat capacity of ambient air, so that the approximate total amount of heat removed by the system may be calculated as desired. Additional cooling by means of air movement is provided in case of the frontal panel by the movement of the wearer's thorax due to normal respiration activity.

As can be seen from the formula, improved air cooling, i.e., greater air flow rate (within reasonable limits) will be achieved by increasing the cross-sectional area of the space (s) between the inner surface of the protective panel and wearer (variable A of above formula). This can be achieved, in part, by making the individual vertical elements (spacers) narrower (but not so narrow that wearer discomfort results). As part of this, the sum total of the volume fraction within the protective device that is between the inner surface of the plate carrier and the wearer's body that is taken up by spacers should be relatively small, so that the cross-sectional area for the air flow is not decreased unnecessarily. This increase in magnitude of variable A can also be achieved by making the vertical elements displace the protective device inner surface further away from the wearer (again, within reason, so that excessive bulk is not created). Further, the vertical elements should be placed along the vertical edges of the protective device's rigid plate (and/or its container), as far as reasonably possible from each other for greater cross-section area (without making the device unreasonably bulky and cumbersome to wear). Also, fewer vertical elements will provide less of a "loss" of cross-section area, so there should not be more than six (6) spaces, and therefore seven (7) vertical elements provided per side and/or per panel.

The vertical elements should not be excessively wide for this reason (their approximate optimal dimensions are disclosed elsewhere in the instant disclosure). An additional and very important reason for the narrow dimensions of the vertical elements is the need for highly effective and more rapid mass transfer of perspiration and cooling air through the spacer's body. It is well understood that spacers are optimally porous so that they allow effective passage of humid air and perspiration through themselves as part of regular use, so that wearer cooling and ventilation are optimized, leading to improved wearer comfort. The laws of mass transfer known to the art of heat and mass transfer equipment design imply that the spacers' area in contact with the wearer's body and/or clothing should optimally be as reasonably narrow as possible without creating spacer mechanical strength issues or pressure-related discomfort for wearer. When two relatively narrow spacers (one at each edge of a rigid panel) are insufficient for the reasons mentioned, additional spacer(s) should be added between them, rather than increasing the size of each spacer beyond the limits taught in the instant disclosure. The spacers, further, should be located in ways that result in improved heat and mass transfer, namely as reasonably far from each other as possible, while consistent with creating wearer comfort (e.g., accommodating wearers' anatomy, such as male or female). In simple terms, there can exist a situation, usually found in prior art equipment, were the spacer(s) are relatively wide; i.e., the line of immediate contact between spacer and wearer's body and/or clothing is relatively extended (e.g., longer than, or about 7 cm). This line is located and measured between a spacer and wearer's body and/or clothing on a horizontal plane cross-section of wearer and protective device combination along the line of immediate contact between wearer and spacer. This situation is undesirable because it leads to poor cooling and in turn wearer discomfort, and devices containing such a feature are outside the scope of the instant invention. Specifically, the mass and heat transfer that are responsible for user comfort via ventilation and evaporation from the spacer-covered area in prior art devices become relatively poor due to the appreciable impeding factor of the prior art spacer's extended dimensions. It is a critical part of the instant invention that the distance for mass and heat transfer in this context be relatively short. In practice, this is achieved by ensuring the line of contact is short. This way, mass transfer of perspiration and humid air from wearer area in contact with spacer is rapid and effective; the high rate of air flow past the spacer's surface that is not in contact with wearer that is created by the other aspects of the instant invention further assists in the process of obtaining optimal comfort for wearer with respect to cooling effectiveness.

The vertical elements should not exceed about 30 degrees' deviation from vertical in each plane, and preferably should not exceed about 15 degrees of said deviation in each plane. Preferred angle of deviation is 10-15 degrees, and more preferably 11-12 degrees. It is understood that some deviation from vertical direction within the limits described is useful in certain situations to enable a good fit of protective device to user, and can be important to prevent the protective device from creating user discomfort, impediment to movement of wearer's extremities, to make the device less bulky, and the like.

As can be further seen from the above formula, improved cooling (greater airflow) will also be achieved from a greater height of the space created between inner surface of protective device, spacers, and wearer (variable h of the above formula). To this end, it is preferably desirable that the vertical elements extend uninterrupted in a substantially continuous fashion to the full extent of the vertical dimension of the entire protective device (and not just the rigid plate) that would be practical (the extent where such spacer would be expected to have contact with wearer's body and/or clothing). As can be appreciated, by using the combination of techniques taught above, it is possible to design a variety of protective devices for numerous activities that are all based on the general principle of using rigid protective panels that are suitable for specific activity in question, that are located at a distance from the wearer by means of spacers, where optimal geometries of spacers and air spaces is disclosed herein, in order to create highly effective systems for wearer cooling.

An additional advantage of the designs taught in the instant disclosure is the additional usefulness of the space(s) created between wearer and the rigid panel(s). In ballistic applications, a phenomenon known to the art as "back-face deformation" can result in moderate to severe wearer injury even when a projectile is successfully stopped, when parts of the ballistic panel back-face are deformed by the processes associated with stopping the projectile and the back-face impacts the wearer with significant force. This injury can be reduced greatly or eliminated with the use of the instant invention's spaces because the back-face does not impact the wearer in such cases (or makes a far less significant contact). In athletic applications, a similar phenomenon also exists, where the back-face of a piece of athletic protective gear impacts the wearer after the exterior of gear is impacted in some way. When using devices made in accordance with the instant invention, this deformation either does not result in impact to wearer, or the impact is greatly reduced, thus preventing many significant wearer injuries, or reducing their severity significantly.

Discussion of Selected Preferred Embodiments

In one preferred embodiment of the instant invention, a set of two rigid standalone ballistic panels, commonly termed "plates" (one frontal and one dorsal) is employed, of Level IIIA, III or IV, per NIJ standard (or similar), wherein each panel is approximately 20-30 cm wide at its widest point and approximately 25-45 cm high at the point of greatest height, possessing a thickness of between about 4 mm and about 40 mm and optionally approximately rectangular in shape. The exact materials of construction and details of shape of the panels are not critical, although generally such plates have an approximately rectangular shape with some curvature and varied geometry; plates with some of the corners removed/rounded, and having trapezoidal shape features are also within the scope of the instant description and invention. The panels in common use may be flat, or curved in one or more planes for user convenience and comfort; they may also be rectangular or polygonal in shape as desired for user convenience and comfort. The ballistic panels are contained in a carrier of general type well known to the art of producing what are known as "plate carriers" for locating the ballistic panels on the wearer in a way that is useful for protecting the wearer's vital organs, said carriers composed at least to a significant extent of textile and/or other material(s) suitable for the application. As is well known to the art, the plate carrier is designed in a way that provides for relatively low amount of plate movement within the carrier. The carriers are usually designed to be highly adjustable to fit a wide variety of users' shapes and sizes (male, female, adolescent, children), and include features to enable a range of user adjustments. The interior surfaces (those facing the body of the wearer) of both frontal and dorsal "plate carrier" elements each possesses a pair of vertical elastic "spacer" elements, roughly square, rectangular, annular, circular, tubular, trapezoidal, semi-circular, or oblong in cross-section, with a cross-section area of about 5 to about 50 square centimeters each, and composed of resilient flexible foam. Each of the elements is continuous, extending about 25-45 cm, more preferably 25-35 cm, and most preferably about 28-30 cm (but should be sized based on the size of the wearer) along the outer vertical region of the interior surface of the plate carrier and extends the full length of the said area of the plate carrier. They may optionally be mesh-covered for user comfort and convenience.

The result of this is creation of an approximately rectangular (in terms of cross-section by a horizontal plane) space, with one dimension (termed depth for the purposes of instant discussion) between about 1 cm and about 5 cm (most preferably 2-3 cm, and most preferably 2.4-2.6 cm), and another dimension (termed width for the purposes of instant discussion) between about 15 and about 25 cm (more preferably 18-22 cm). Thus, the air space between the wearer and the inner surface of the plate carrier can be described as roughly approximating a rectangular cuboid, with a height of about 25-45 cm, and possessing a width of about 15-25 cm, and a depth of about 0.5-5 cm (more preferably 1.5-3 cm, and most preferably 2-2.5 cm) (this is smaller than spacer height because the spacer compresses when the plate carrier is worn by its user, and also the body of wearer may protrude into the space beyond the line of contact of wearer with spacer). It is important to use a sufficient size of spacer to prevent this air space from being excessively occluded by wearer's body and/or clothing; if the space is occluded, the cooling system will not function as intended because the stack effect will not occur. This space is responsible for creating the "stack effect" for each panel having such a space, and for effective cooling of wearer. The space must be open and without significant obstructions to ascending air flow at its the top and bottom, so that colder air can enter through the bottom opening, and so that air that has been heated by way of heat transfer from wearer and spacers to said air can exit through the top opening.

The carrier outer surface may have optional elements for attachment of assorted devices, equipment, grab handle(s), arms, ammunition, accessories, supplies, insignia, etc.; the same may also be optionally attached to additional optional elements of the plate carrier or elements attached thereto, located below the axillary region(s) of the wearer, or elsewhere.

The exact form of the plate carrier and exact form of the rigid ballistic plate(s)(aside from the required elements described herein) are not critical. It is important that the wearer adjust the plate carrier and plate(s) combination so that the plate(s) therein are positioned so as to provide correct coverage of salient features of wearer's cardiovascular system.

It can be readily appreciated that the invention described herein is relatively inexpensive to incorporate into various plate carrier systems, and is very simple to implement using existing techniques of plate carrier construction and using materials, methods, and designs already in wide use and well known to the art. While being simple and easy and inexpensive to implement, it remains highly effective and needs no external power, as well as extremely light, an important factor for wearers of hard armor plates that have to contend with armor weight-induced issues.

The use of plate carrier(s) and other devices incorporating the instant invention can be widely varied, such as by security forces, law enforcement, military, and those engaging in occupations and/or activities that are at increased risk of intentional or accidental shooting. Such personnel include most ages (three years of age and above), but are in no way limited to, employees of firing ranges, those working in retail establishments, those engaged in shooting competitions and training in firearms use, those engaged in hunting activities, and the like, those engaged in transport of valuables, medical and pharmacy professionals, and so on. Further uses of devices incorporating the instant invention in its many possible forms are readily apparent to one skilled in the art, as are potential modifications, such as, for example, making smaller or larger versions, proportionally sized but incorporating smaller or larger hard armor plate(s) and smaller or larger carrier dimensions in appropriate respects, for use by those of smaller or larger stature and by younger users, male, female, children, etc. Suitable modifications to dimensions and specific feature elements of the instant invention's embodiments for use by male and female users are also easily made by those skilled in the art of tactical equipment design and fabrication. Such modifications are all well within the scope of the instant invention. Also included in the instant invention is the use of variable cross-section area and/or geometry of spacers along the length of same, to accommodate various body shapes of wearers. The spacers may be swappable, removable/replaceable, relocatable, etc., in ways well known to the art of tactical textile product design and production.

The invention described herein is not limited to plate carriers per se, but may be incorporated into other devices possessing rigid ballistic panels that are worn by users on or about their body. Another non-limiting example of using the instant invention can be the manufacture and use of a backpack for use by students and others (teachers, shoppers, hunters, etc.), possessing a hard armor panel, such as those of Level IIIA, II or IV ("standalone" or "in conjunction"). In such an embodiment, a panel in a carrier made in accordance with the instant invention can be worn dorsally, and a backpack-type structure can be conveniently attached to the outer surface thereof using quick-release type fasteners and/or zipper(s) well known to the art of backpack manufacturing. Such a backpack can be used as a means of incorporating ballistic resistant and easily worn items into objects of general utility. Further, the backpack part of the structure can be easily and rapidly detached from the plate carrier part for enhanced user mobility in emergency situations; the plate carrier and its ballistic panel contained therein can then be used dorsally, or redeployed frontally if needed. In an additional non-limiting example, a plate carrier may have a frontal and a dorsal plate, each of these sections with preferably 2-3 approximately vertical spacer elements of appropriate size and location. It may also contain four ballistic plates placed around the torso of the wearer, namely frontal, dorsal, left side and right side, with each of the side sections preferably having 2 vertical spacer elements, preferably at the vertical outer edge of each panel. As part of the instant invention, a vertical spacer element may also be "shared" between two adjacent panels, so that, for example, a single vertical spacer element may be used for displacing both a frontal and a side panel away from the wearer.

An important element of the practice of the instant invention is the appropriate selection of the properties of materials for construction of spacers. They need to possess appropriate resistance to compression and suitable balance of various material properties for both wearer protection and wearer comfort. The specific methods of construction and processes for selecting and optimizing materials are well known to the art of construction of ballistic protective equipment and athletic protective equipment, respectively.

EXAMPLES

Experimental ballistic application series using human subject and thermal measurement.

A series of experiments were performed on a male subject using a set of 20×30 cm plates (NIJ Level IV standalone) of approximately rectangular shape and having a thickness of about 25 mm, in a commercially available plate carrier possessing a substantially flat interior surface that was composed of a mesh-type material over an elastic foam backing. The frontal and dorsal plates, as well as each of plate carrier "halves", were of substantially identical design and construction. Temperature measurements and carrier modifications were performed only on the front plate for convenience and simplicity for experiments A through D, inclusive.

Temperature references:

T1=outside armor surface temperature

T2=temperature in space between clothing and interior surface of plate carrier

T3=ambient air temperature

T4=body temperature

Experiment A

Instrument and wear armor "as shipped" and walk around room briskly. Allow all 4 temperatures to stabilize over several minutes. Record temperatures.

T1=22.1 C; T2=31.8 C; T3=20.4 C; 14=33.8 C

Heating vs. ambient temperature is T2−T3=11.4 C

Personal impression: it gets quite warm, quickly.

Experiment B

Modified in accordance with instant invention. Foam cylinders were attached in vertical direction along interior surface of carrier, using closed cell foam. The two cylinders were located along the outer vertical edges of approximately rectangular plate carrier to create air gap between plate and clothing, and to allow free movement of air in upward direction in the space created. Cylinder length: 30 cm, diameter 3.8 cm. Note: no significant discomfort observed due to added foam elements, although plate carrier fit needs some adjustment as expected. The width of the "contact patch" of the spacers with the wearer clothing is approximately 15 mm.

Repeat Experiment A measurements and record temperatures.

T1=22.6; T2=26.2; T3=22.1; T4=33.5

Result discussion: Outside armor T change (T1) not significant for experiments A vs. 13. T2 significantly cooler, as expected (by 5.6 C).

Personal impression: cooling is much better.

This is especially important since ambient temperature (T3) rose during this experiment by 1.7 C, so therefore the cooling effect vs. ambient temperature is greater Experiment A has delta T2−T3=11.4 C of temperature rise Experiment B has delta T2−T3=4.1 C of temperature rise Conclusion: temperature rise with modification in accordance with the invention is much lower, illustrating the "stack effect" producing air flow that cools the wearer significantly by drawing in colder air from bottom and expelling hotter air at the top.

Experiment C

Repeat Experiment B, but place same cylinders horizontally along top and bottom edges of plate carrier. This is to illustrate that the direction of elements creating air gap between wearer and interior of armor is important to achieve cooling effect, and that merely having an air gap of adequate size between clothing and interior surface of plate carrier is not resulting in the same amount of cooling as that provided by the invention.

Repeat measurements as per Experiment B.

T1=23.0; T2=26.8; T3=21.6; T4=33.6 Delta T2−T3=5.2 C of temperature rise

Comparison: temperature rise for Experiment C is higher (5.2 C) than for Experiment B (4.1 C)

Personal impression: cooling is still much better than no air gap (Experiment A), but not as good as with the vertical orientation of foam tubes (Experiment B). The cooling effect on frontal panel in this case is better than that expected on dorsal panel due to air circulation provided by thoracic movement due to breathing. It is expected that cooling via an air gap not in accordance with the instant invention on dorsal panel will be less effective.

Experiment D

Repeat Experiment B, but measure temperature differential between air at "intake" of air gap and air at "outlet" of air gap to illustrate airflow-induced heat transfer created by the invention. Use temperature measurement device in differential mode.

Temperature differential reading stabilizes at 2.0 degrees C. difference. This illustrates a significant airflow between the interior surface of the plate carrier and wearer when plate carrier is operated in accordance with the instant invention. If airflow was inadequate, the temperature differential would be much greater, on the order of difference between T2 and T3 in Experiment A, which is 11.4 C.

Experimental ballistic application series using instrumented system and thermal measurement.

A symmetric wooden frame approximately analogous to medium sized human torso in dimensions (width, height, depth) was obtained, and clothing was placed on it to simulate a user (dummy). The interior of the dummy was equipped to be electrically heated using circulating hot air provided by a hot air blower with dissipated power of about 600 W. A plate carrier with two identical, approximately rectangular, NIJ Level IV plates, sized 20×30×2.5 cm inserted therein, was placed on the dummy over the clothing to simulate a person wearing the plates in a plate carrier and progressively overheating. Commercially available plate carrier possessing a substantially flat interior surface that was composed of a mesh-type material over an elastic foam backing was used. The frontal and dorsal plates, as well as each of plate carrier "halves", were of substantially identical design and construction. The plate carrier "half" was approximately 33×29 cm size (H×W). One of the plate carrier halves was used "as is", and the second was modified in accordance with the instant invention as described in Experiment B. The modifications consisted of two foam cylinders that were attached in a vertical direction along interior surface of plate carrier, using closed cell foam. The two cylinders were located along the outer vertical edges of plate carrier to create a single air gap between plate carrier and clothing, leaving an open, roughly rectangular gap at the bottom and a similar one at the top of the simulated torso, and to allow free movement of air in upward direction in the space created. Cylinder length: 30 cm, diameter 3.8 cm. Air gap cross-section approximately 3.5 cm by 21 cm. The width of the "contact patch" of the spacers with the clothing is approximately 1.5 cm. The plate carrier's armor panels and the clothing fabric on the frame were both instrumented with suitable thermocouples, and temperatures were recorded after the meter and thermocouples were properly calibrated (similar to experiments A-D).

The measurements were done on the following locations: unmodified armor panel, clothing outer surface under unmodified plate carrier half, modified armor panel, clothing outer surface under modified plate carrier half. Other than the plate carrier modification in accordance with the instant invention, the sides were substantially identical in construction, placement/location of thermocouples, dimensions, and all other material aspects.

At the beginning of the experiment, the heating system was turned on, and temperatures were recorded every 60 seconds. The experiments confirmed that the plate carrier of the instant invention provides for significantly better heat dissipation from simulated wearer than prior art plate carrier under same conditions.

The temperatures were recorded several times (every 60 seconds) and also at various locations along the center line of the simulated wearer's clothing. The sensor locations were on the outer surface of simulated plate carrier wearer's clothing, and placed at clothing locations corresponding to the bottom, middle, and top of the plate carrier. The goal was to determine whether the invention's overall concept of operation would provide significant cooling to the simulated plate carrier wearer at various temperatures, and to quantitatively measure the cooling effect of the instant invention at different locations on the simulated wearer's body.

The experiments generally proceeded from room temperature until the simulated wearer's clothing reached about 50 degrees C. temperature (to simulate service in hot climates), and then heating was turned off and further temperature readings taken for an additional period of time as the system cooled. The temperatures and the amount of cooling observed, as shown by a temperature differential for clothing temperatures observed between prior art and inventive design, were charted; the charts are attached below.

As expected, greater cooling effect was observed at higher simulated-wearer temperatures. This is due to the increased cooling air flow predicted by the formula referred to above, when difference between To and Ti is increased. Thus, by using the instant invention, users at higher clothing and body temperatures will automatically be provided greater cooling.

Also, as expected, the temperature differential "advantage" at the clothing location corresponding to the top of the plate carrier is significantly less when compared to locations corresponding to clothing located at the bottom and in the middle of the plate carrier, since the air being taken in at the bottom cooling opening becomes heated as it proceeds upwards through the gap provided for air cooling of the user through the process of heat exchange/transfer, which is how the plate carrier wearer is being cooled. Since the air, by the time it reaches the "exhaust" location, has absorbed a significant amount of heat and significantly cooled the simulated wearer already, it is less able to provide cooling at the end of its passage than it is at locations on clothing nearer the bottom and in the middle of the plate carrier. This further illustrates the effectiveness of the invention in terms of its ultimate goal, namely enhanced heat removal/transfer from plate carrier wearer. This further suggests the simulation is adequately modeling real world phenomena well known to the art of heat exchange system and cooling system design.

The temperature differentials and the actual simulated-wearer clothing temperatures for both prior art and for inventive example are shown in the charts below for three locations on clothing corresponding to top, middle, and bottom of plate carrier.

Notes to charts below:

Red=temperatures of clothing outer surface with prior art plate carrier

Blue=temperatures of clothing outer surface with plate carrier of the instant invention Green=temperature differential between prior art and instant invention, with 0.5 C error bars included for clarity Instrumentation Note:

Measurement device: 4-channel thermocouple meter (SmartSensor AS 887), 4 type K thermocouples, bead type exposed junction. System calibration: within 0.3 degree C. for all probes. Resolution: 0.1 C; instrument nominal accuracy 0.5 C.

Figure 17:
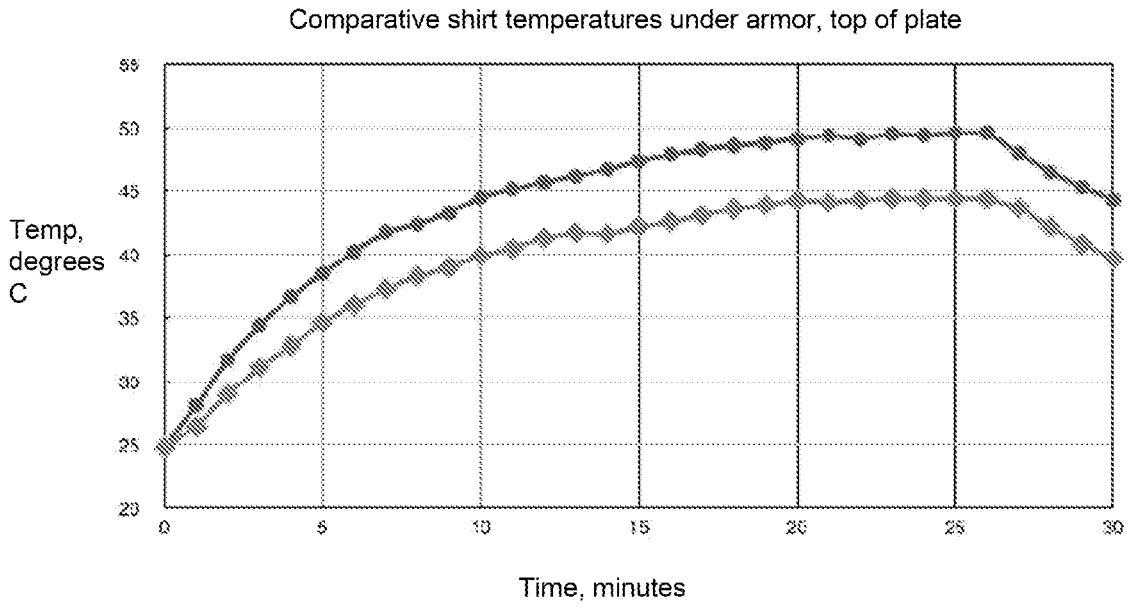
FIG. 17 illustrates a comparative graph demonstrating the temperatures over time measured at top of plate of the present invention in blue square line and the prior art in red circle lines.
Figure 18:
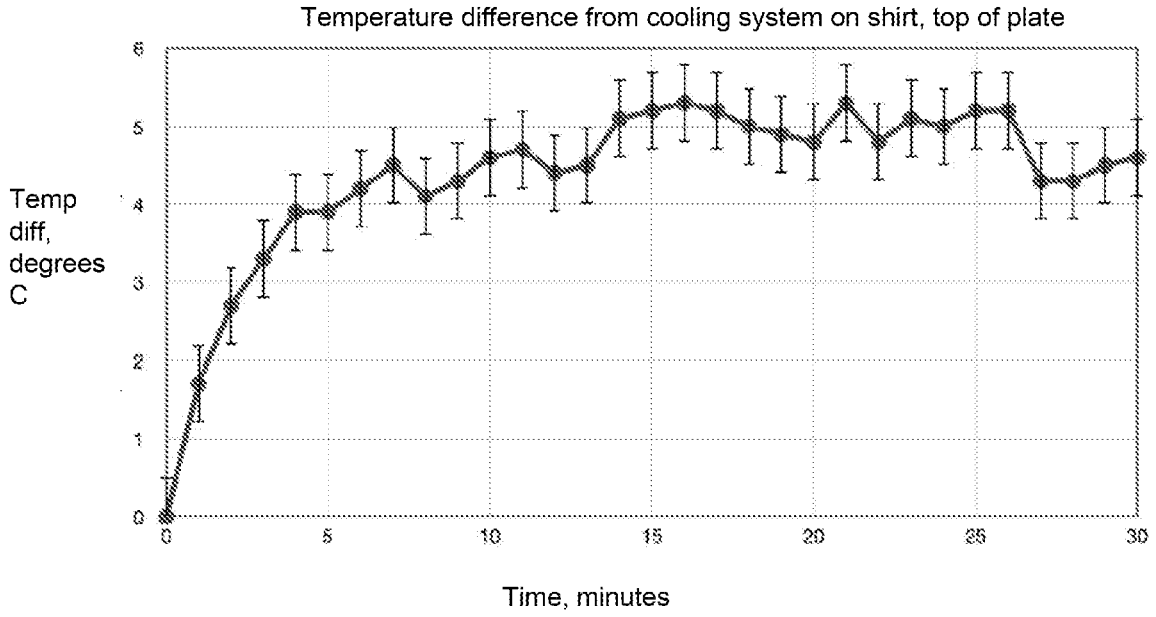
FIG. 18 illustrates a comparative graph demonstrating the temperature differential over time of data in FIG. 17.

Results for Experiment 1, measured at the top of the plate, are shown in FIGS. 17-18. FIG. 17 demonstrates the comparative shirt temperature under armor, and FIG. 18 demonstrates the temperature differential.

Figure 19:
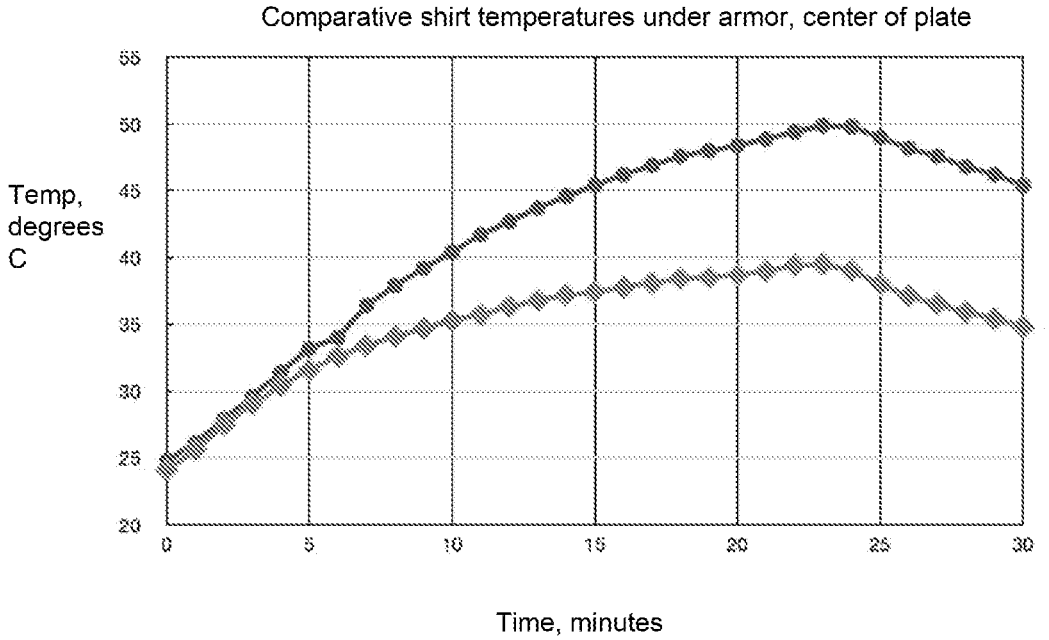
FIG. 19 illustrates a comparative graph demonstrating the temperatures over time measured at center of plate of the present invention in blue square line and the prior art in red circle lines.
Figure 20:
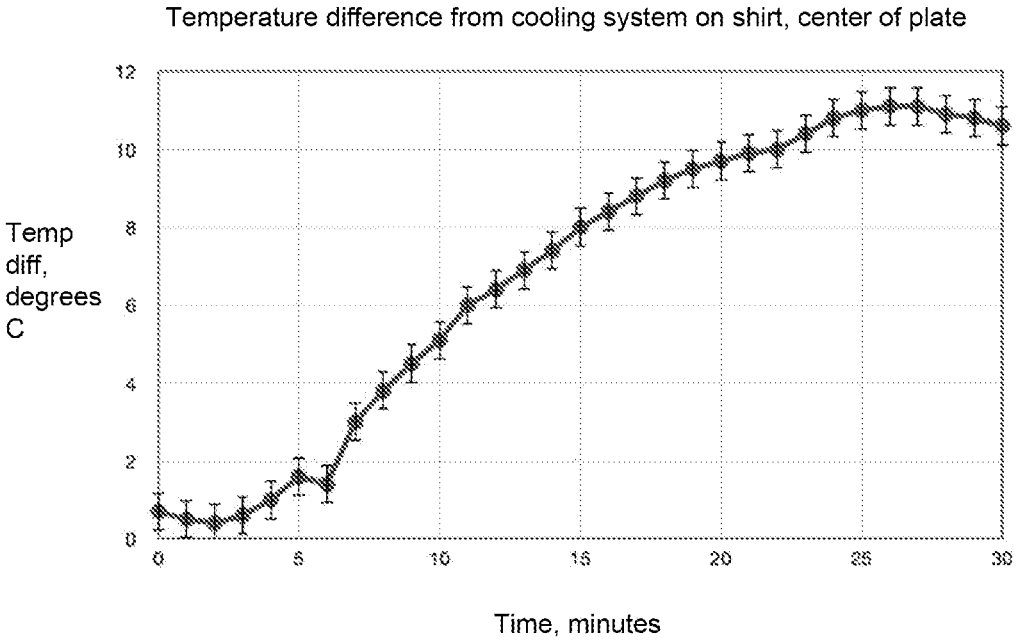
FIG. 20 illustrates a comparative graph demonstrating the temperature differential over time of data in FIG. 19.

Results for Experiment 2, measured at the center of the plate, are shown in FIGS. 19-20. FIG. 19 demonstrates the comparative shirt temperature under armor, and FIG. 20 demonstrates the temperature differential.

Figure 21:
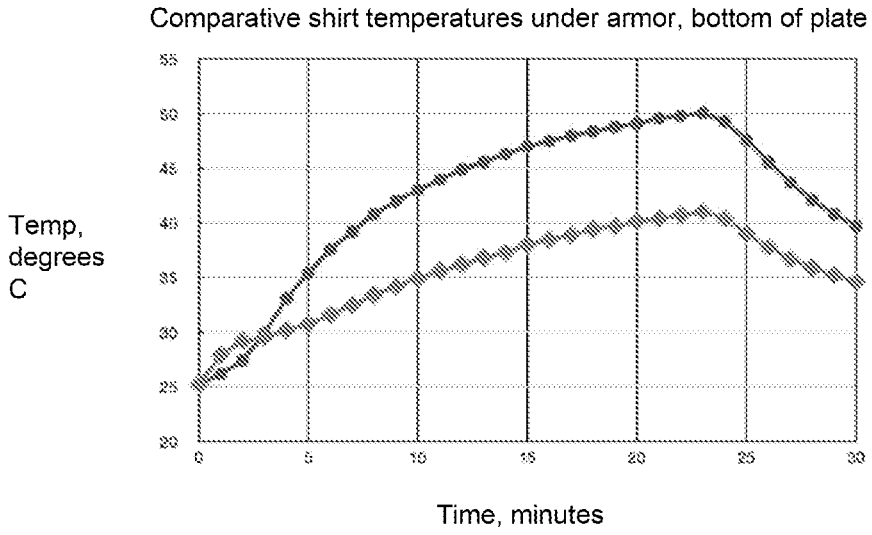
FIG. 21 illustrates a comparative graph demonstrating the temperatures over time measured at bottom of plate of the present invention in blue square line and the prior art in red circle lines.
Figure 22:
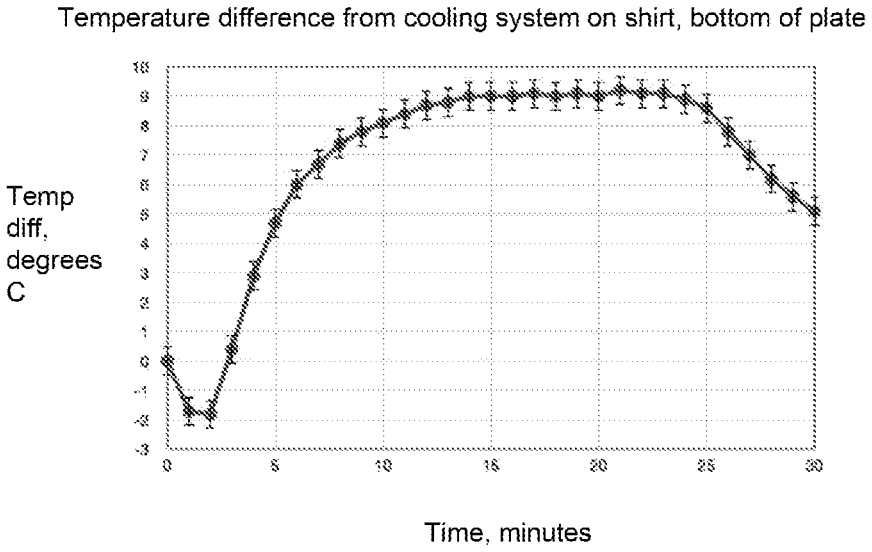
FIG. 22 illustrates a comparative graph demonstrating the temperature differential over time of data in FIG. 21.

Results for Experiment 3, measured at the bottom of the plate, are shown in FIGS. 21-22. FIG. 21 demonstrates the comparative shirt temperature under armor, and FIG. 22 demonstrates the temperature differential.

Each of the experiments were conducted separately, and temperatures depicted were those of the shirt on the dummy/wearer and not of the plate itself. The locations were referenced relative to the plates' locations overlaying the shirt, but the measurement locations themselves were on the shirt surface. For example, FIG. 17 shows temperatures recorded for experiment measuring clothing surface temperatures under bottom of plate, while FIG. 18 shows the difference between inventive and prior art carrier's shirt surface temperatures at locations corresponding to the top of the plate. In other words, FIG. 17 is from a different experiment than FIG. 18 under it. In theory, "top", "middle" and "bottom" experiments' figures should be together for greater clarity and not separated as they are now.

Experimental athletic application series using instrumented system and impact measurement.

A hollow plastic rectangular cuboid frame was obtained, and a blanket was wrapped around it to simulate a user (hereinafter, "dummy"). A new, never worn, commercially available baseball chest protector meeting current NOCSAE specifications (either unmodified, or modified in accordance with the instant invention as described below) was placed on the dummy to simulate a person wearing the protective equipment. The dummy was equipped with a pocket for insertion of "impact witness disc" in a polyethylene film bag. The disc was located on the dummy in its pocket and centered behind the center of the impact zone of the chest protector, as defined by manufacturer's product design. The impact witness disc was a standard sporting clays target of approximately 108 mm diameter, selected for ease of identifying whether a significant impact has occurred to it or not and achieving a qualitative estimate of impact severity on the dummy itself in the target area. Thus, the amount of damage to the disc would be used as a proxy for qualitatively determining the degree of protection afforded by a protector device. A commercial baseball launching device, using standard practice baseballs, was employed to provide for baseball impact velocity of approximately 95 kilometers per hour. This simulated a hit to the protector when it is placed behind the base plate from a baseball thrown at an approximate velocity (as conventionally measured) of about 67 miles per hour (when leaving the pitcher's hand), a relatively moderate velocity but well in excess of the current NOCSAE test standard. The ball launcher was set to impact the center of the chest protector impact zone, the event being subjected to slow motion video recording and subsequent review, to confirm the hit was "fair" and impacted the approximate center as intended.

Experiment A1

A single baseball was launched at the dummy "wearing" the un-modified protector, and impacted at about the center of the chest protector impact zone, the event being subjected to slow motion video recording and subsequent review, to confirm the hit was "fair" and impacted the approximate center as intended. The impact witness disc was carefully recovered and photographed. It was shattered into a very large number of smaller pieces, suggesting that there was a severe impact to the disc, and a large amount of energy would be transferred to the person being protected in an analogous impact with a live user. Further, and unexpectedly, significant damage to the dummy's internal structure from the single impact was found (multiple internal parts breakage). This combination of observations qualitatively suggests that NOCSAE standard compliant protective equipment provides a relatively insufficient amount of impact protection to the wearer when subject to impact from baseballs thrown by typical pitchers in many settings such as middle school and high school pitchers' activity, as well as collegiate ones. Thus, existing equipment is not adequately protecting wearers from injury even though it is standards-compliant.

Experiment A2

The chest protector device of example A1 was modified in accordance with the instant invention as described below. A flat square plate made of hardened aluminum alloy (7075) with an edge length of about 20 cm, and a thickness of about 3.17 mm (plus or minus 0.10 mm) was attached to the back (wearer) face of the impact area, with the edges being approximately vertical and the plate approximately centered on the impact area. The plate weight was about 360 g (under 0.8 lbs.). The plate was attached to chest protector using hook and loop fasteners for convenience. The wearer side of the plate was equipped with two vertical spacers made of closed-cell polyethylene foam. The foam properties were as follows: density about 48 kg per cubic meter, pressure to compress by 25% about 0.91 kg per square centimeter. Spacers were approximately rectangular cuboid in shape. The spacer vertical dimension was about 31 cm and extended down from the top of the impact zone (and thus from the top of the plate as well). The length of spacers' line of contact with the dummy in the horizontal plane was about 2.5 cm, and the distance from the dummy to the plate created by the spacers was about 4.5-5.0 cm. The spacers were located on the extreme right and extreme left sides of the aluminum alloy plate. The airspace created by the spacers was approximately 31 cm high, about 15 cm wide, and about 4.5 cm deep. Thus, the air gap cross-section by a horizontal plane is about 15 cm by about 4.5 cm in this instance. Note that the space being created does not necessarily need to be limited to the plate dimensions.

Three baseballs in sequence, one right after the other, at identical speed (same as in Example A1) were launched at the dummy and each impacted at about the center of the chest protector impact zone, the events being subjected to slow motion video recording and subsequent review, to confirm the hits were "fair" and each impacted the approximate center as intended. The impact witness disc was carefully recovered and photographed. It was entirely undamaged, suggesting that there was no significant impact to the disc, and at least a very major fraction of impact energy would not be transferred to the precordium region of the person being protected in analogous impacts with a live user. Further, and unexpectedly, no damage to the dummy's internal structure from the multiple impacts was found. The metal plate was not deformed by these impacts, showing it had sufficient rigidity and structural resilience. The experiment results on the dummy further suggest that the spacers were effective in reducing impact and trauma to the simulated user, since in this experiment, the same impact energy of projectiles failed to cause any damage to the dummy, unlike prior art experiment A1, where the same impacts resulted in significant internal damage to the dummy.

This set of experiments suggests that the structures proposed herein are effective at preventing and/or very significantly reducing injury and/or impact to the wearer's precordium area (and all other areas protected by the plate), even after repeated impacts at relatively high speed, and provide a significantly improved level of protection against impacts compared to prior art devices. The structures also have the advantage of being light in weight, simple in construction, and low in cost, as well as providing cooling utilizing stack effect, protecting wearer from hyperthermia and heat stroke significantly better than prior art devices. Furthermore, they are advantageously reusable and do not need to be replaced after a single severe impact.

Experiment A3

In an effort to study the effectiveness of prior art protection systems, the Prototype 4 of U.S. Pat. No. 7,735,161 was substantially re-created with the following changes: the polycarbonate thickness was altered from specified 0.0263 cm to 0.318 cm (i.e., about 12 times thicker), which should have made it much more impact resistant than prior art. The device was emplaced alone on the dummy above the witness disc and subjected to a single "fair" hit. Otherwise, the experiment was substantially similar to Experiment A1. The impact witness disc was carefully recovered and photographed. It was shattered into a very large number of smaller pieces, suggesting that there was a severe impact to the disc, and a large amount of energy would be transferred to the person being protected in an analogous impact with a live user.

Experiment A4

In a further effort to study the effectiveness of prior art protection systems, the Prototype 4 of U.S. Pat. No. 7,735,161 was substantially re-created with the following changes: the polycarbonate thickness was altered from specified 0.0263 cm to 0.635 cm (i.e., about 24 times thicker). Such changes should have made the device tested in A3 more impact resistant. The device was emplaced alone on the dummy above the witness disc and subjected to a single "fair" hit. The impact witness disc was carefully recovered and photographed. It was shattered into a very large number of smaller pieces, suggesting that there was a severe impact to the disc, and a large amount of energy would be transferred to the person being protected in an analogous impact with a live user.

Experiment A5

In a further effort to study the effectiveness of prior art protection systems, the Experiment A4 was repeated with the following change to materials tested: the device of Experiment A4 was modified by attaching to the inner face of a commercially available chest protector described above. This change should have made it much more impact resistant than prior art or more impact resistant than prior art systems tested in Experiments A3 and A4. The combination was emplaced on the dummy above the witness disc and subjected to a single "fair" hit. The impact witness disc was carefully recovered and photographed. It was shattered into a large number of smaller pieces, suggesting that there was a somewhat severe impact to the disc, and a large amount of energy would still be transferred to the person being protected in an analogous impact with a live user. This suggests that merely modifying the prior art invention with much thicker material is unexpectedly not sufficient to provide adequate protection against higher energy projectiles to users.

Figure 2:
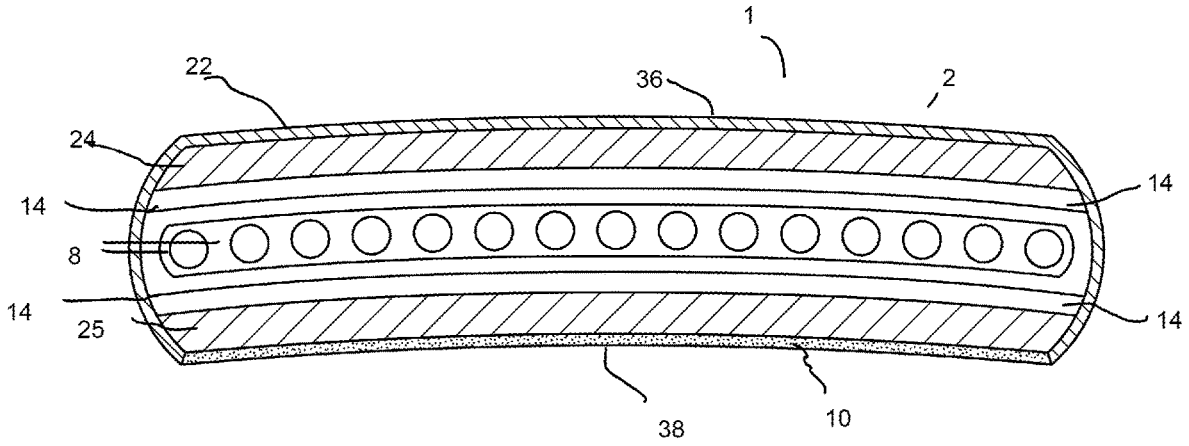
FIG. 2 PRIOR ART
FIG. 2 illustrates a cross-sectional view along lines FIG. 2-FIG. 2 of FIG. 1.

Referring to embodiments of the present invention, FIGS. 1 and 2 demonstrate solutions of the prior art in order to distinguish those of the present invention. Prior art ballistic protective gear shown in FIGS. 1 and 2, demonstrate a system 1 with carrier 2, oriented with top 3 towards top. Outer or front surface 36 of ballistics plate carrier is exposed. System is bound to user by straps (not shown) that can join the system at attachment points 30. System, includes rigid ballistic plate 8 set within a carrier pocket 14. Outer foam layer 24 and inner foam layer 25 serve to give the product a squishy or soft feel. Outer surface 36 includes a fabric layer 22. Interior surface 38 may include a mesh or soft foam-like material 10 to provide for contours of the user's body. Carrier 14 includes fabric liner/lining on both front and back sides. For the purposes of this invention, the term "ballistic" may be used to refer to protective gear in general, including ballistic and athletic gear, or other gear worn by a user. Such protective gear should protect against ballistic impacts, blunt force, sharp, object, and/or high velocity impacts. In athletic context, impacts may be "ballistic" (e.g., balls) but may also be non-ballistic (e.g., to protect wearer from impact by other players, or equine hooves, a situation not commonly referred to as "ballistic").

Figure 3:
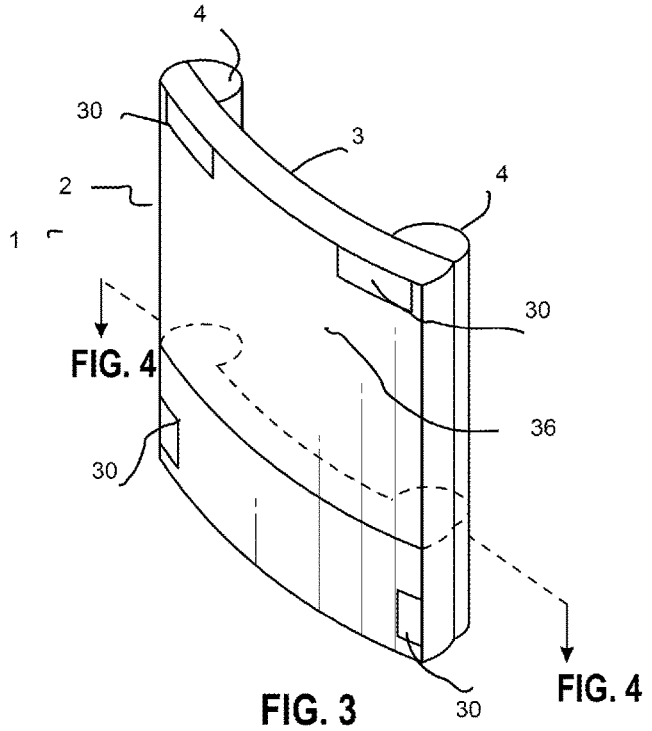
FIG. 3 illustrates a front perspective view of a ballistic protector of an embodiment of the present invention.
Figure 4:
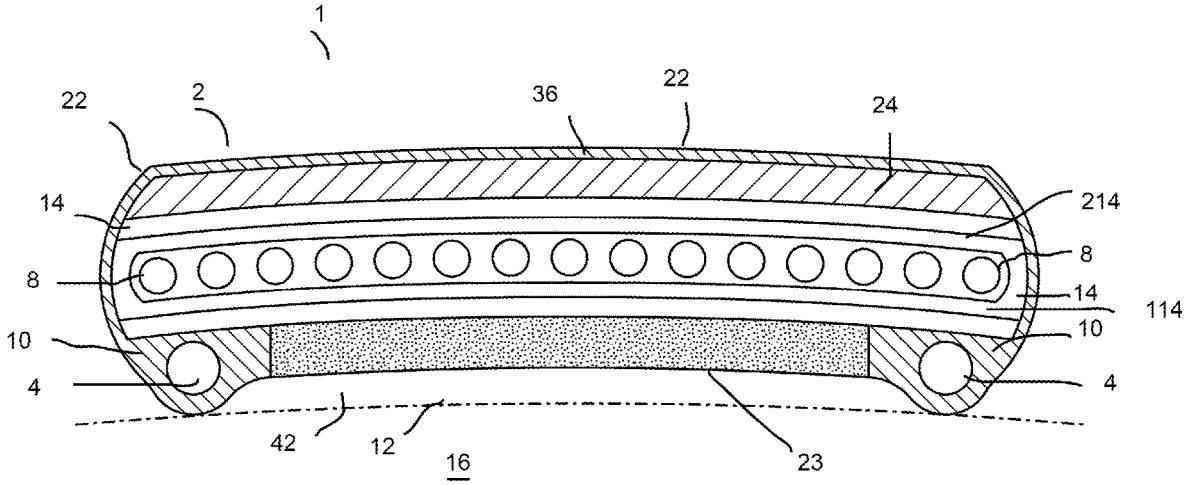
FIG. 4 illustrates a cross-sectional view along lines FIG. 4-FIG. 4 of FIG. 3.

In contrast, an embodiment of the present invention is shown in FIGS. 3-4. System 1 includes rigid plate 8 within carrier pockets 14. Carrier pockets are preferably formed via fabric, such as cloth, cotton, polyester, nylon, Kevlar, or the like. A fabric outer coating 22 is set over exterior of carrier 2. System carrier 2 includes attachment point 30 to allow for straps or other accessories to be mounted thereon to assist in donning the system. For instance, lower attachment points 30 can attach to a belt/waist strap, which upper attachment points 30 may bind to shoulder straps or neck band. Top of system is directed towards head and positioned near thorax. Spacing elements 4, such as cylindrical foam pads, are set within a mesh 10 to be set along torso 16. First initial contact may be muffled by pad 24 under fabric 22 on outer surface. A central gap 12 may form over/front of torso 16, and part of space may be filled with interior fabric 23. Carrier pocket 14 includes interior fabric layer 114 and exterior fabric layer 214 to house rigid panel 8.

Figure 5:
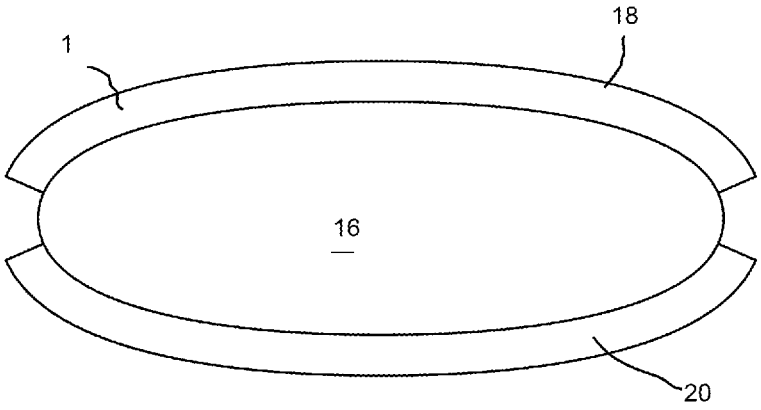
FIG. 5 PRIOR ART
FIG. 5 illustrates a top cross-sectional view of a prior art equestrian guard.
Figure 6:
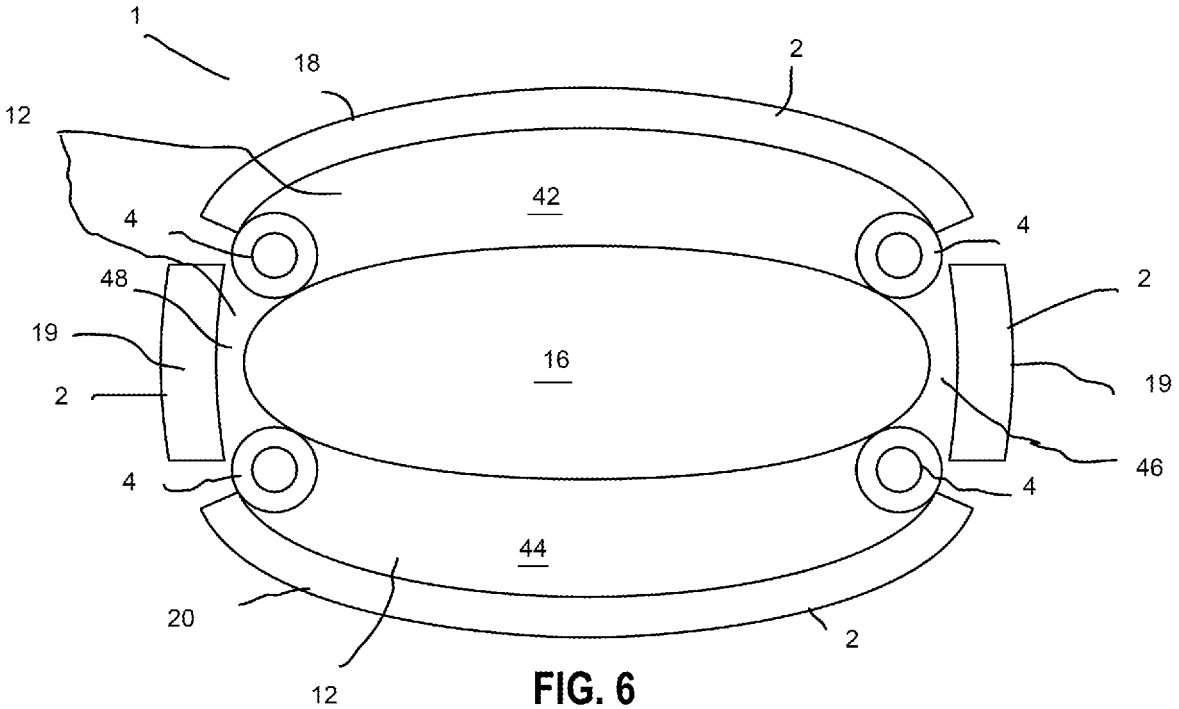
FIG. 6 illustrates a top cross-sectional view of an equestrian guard of an embodiment of the present invention.

Considering equestrian designs to limit blunt impacts, FIGS. 5 and 6 demonstrate cross-sections of the prior art and present invention, respectively. Torso is set within system 1. In the prior art, a front vest element and rear vest element are bound by fabric and emplaced over the torso for intimate contact with the skin or clothing. In contrast, FIG. 6 demonstrates how spacers can be used to make system 1 include multiple carriers 2 that are offset from the torso to provide air gaps 12 for the stack effect. Front panel 18 and rear/dorsal panel 20 maybe coupled via spacing elements 4, shown in cylindrical form. Spacers may be hollow or solid. Side panels 19 may be set laterally to protect the floating ribs and sides. Spacer are preferably annular tubular spacing elements and share by two adjacent panels to minimize the volume of the spacing elements relative to the number of carriers. Front air space 42 and rear air space 44 allow vertical rising air to flow between torso 16 and carriers 2. Similarly, side air spaces, right air space 46 and left air space 48 allow air to flow on the sides. Preferably, there are no obstacles from the space extending form the bottom opening to the top opening in the spaces, 42, 44, 46, and 48 so as to allow unobstructed (near) vertical travel of air path to allow entry of cooler air at bottom and exit of warmer air at top opening. The spaces should be sized wide/deep/large enough to allow for enough air flow to provide a stack effect, as smaller/narrower spaces lead to turbulent air movement and may inhibit stack effect.

Figure 7:
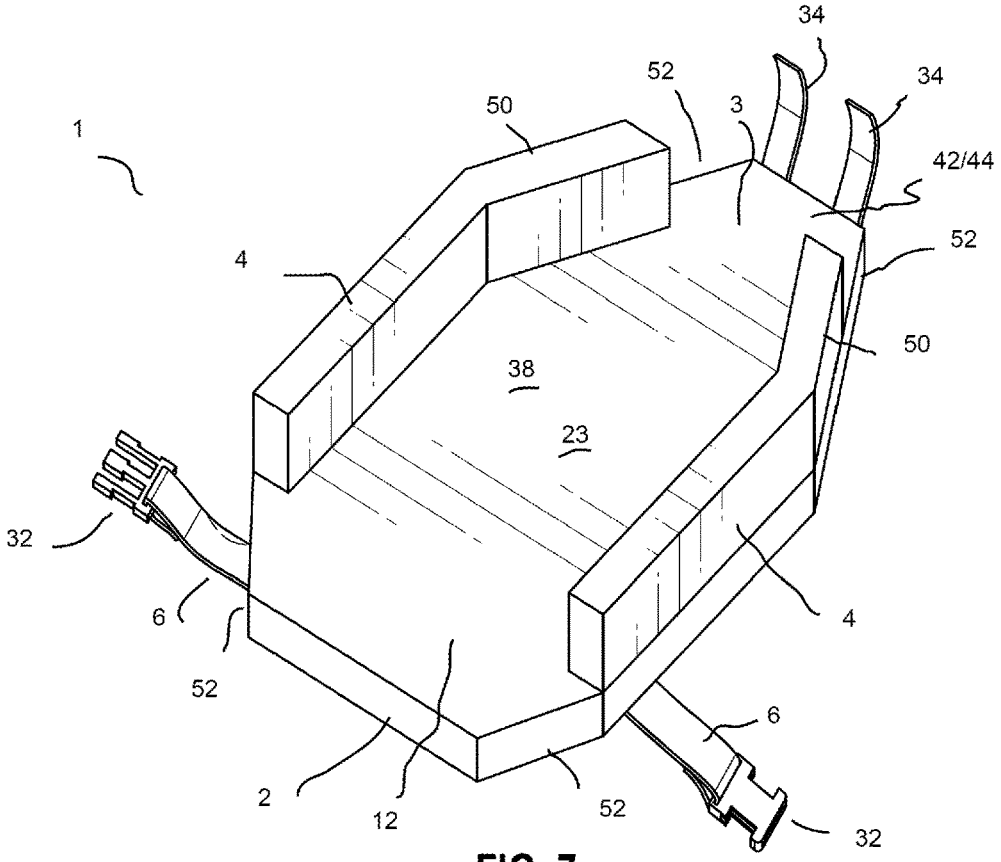
FIG. 7 illustrates rear perspective view of a front protector carrier of an embodiment of the present invention.
Figure 8:
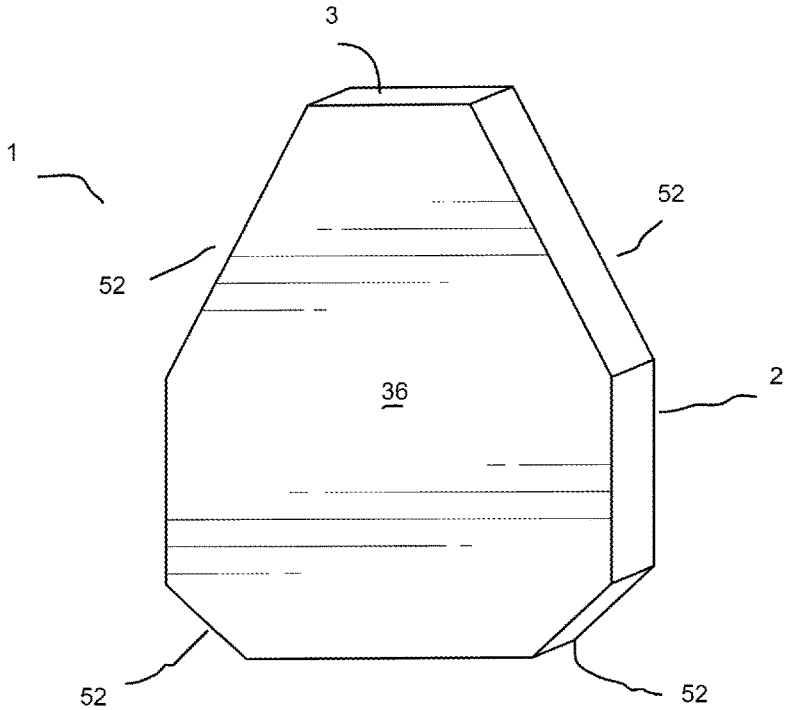
FIG. 8 illustrates a front perspective view of the protector carrier shown in FIG. 7.
Figure 9:
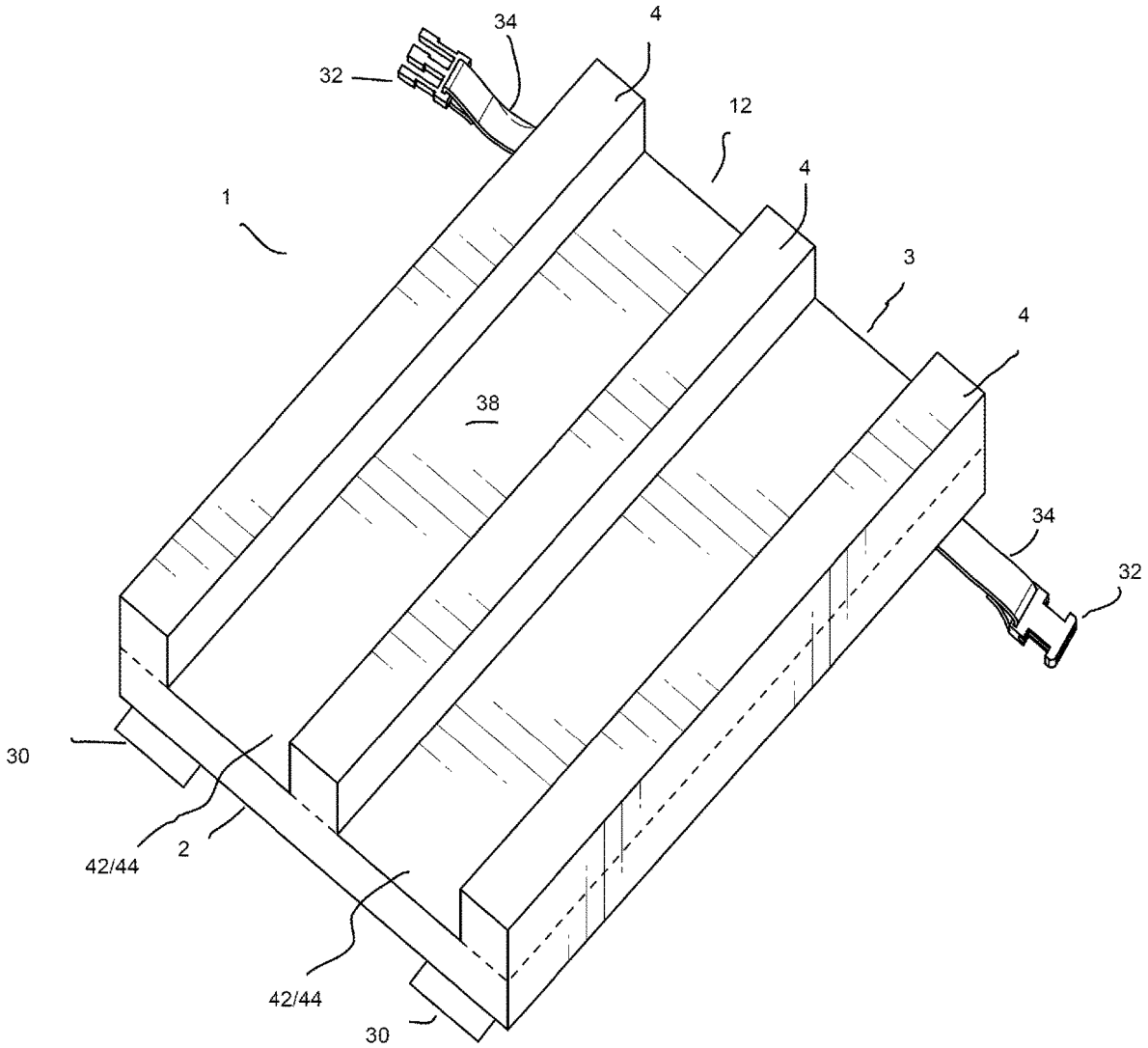
FIG. 9 illustrates rear perspective view of a front protector carrier of another embodiment of the present invention.

Ballistic or bullet protective vests, or athletic apparel embodiments are shown in FIGS. 7-9. System 1 includes carrier 2 to hold a rigid panel therein. Cloth or fabric may encapsulate the carrier compartment(s). Interior surface 38 faces user, while outer surface 36 faces the field and/or environment. Spacers 4 may include vertical bars (As described above), as well as angled spacer elements 50 that can further deflect stacked airflow over thorax near top 3. In this embodiment, angled spacer elements 50 deflect and focus air flowing upwards due to stack effect to the central thorax area to provide additional cooling effect. Carrier shape may include cut outs 52 to make the product more comfortable/ergonomic and/or improve arm and/or leg freedom of movement. Cuts 52 may provide for improved upper/lower extremity mobility and further serve to reduce bulk by allowing smaller rigid panel sized and shaped to cover vital portions, while exposing sections less prone to injury. Gap 12 may be set between user('s clothing) and fabric interior lining 23. Belt straps 6 may be mounted around the waist of the user and coupled via quick connect buckles 32. Shoulder straps 34 are preferably padded and mount on the clothing, or mate with a complementary carrier for the opposite side of the body. Shoulder straps (as shown in FIG. 9) may include buckles 32 to mount around neck or under shoulders. For reference, exemplary dimensions for a triple spacing element system may include each spacing element distanced from another laterally by 6 to 12 cm (more preferably 8-11 cm, and most preferably at least 10 cm), assuming a vertical rise of about 27 cm. The central spacing element may have a thickness on the order of 25% to 100% of the outer side spacing elements for ergonomic purposes.

Figure 10:
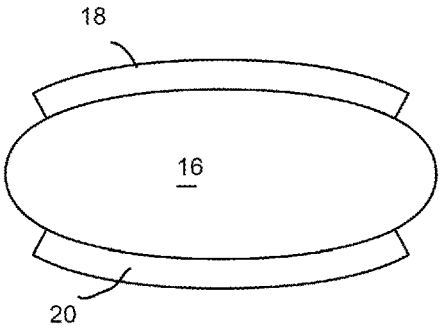
FIG. 10 PRIOR ART
FIG. 10 illustrates a top cross-sectional view of a prior art dual vest guard.
Figure 11:
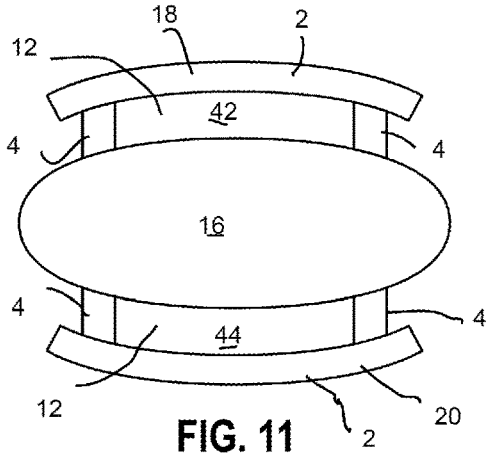
FIG. 11 illustrates a top cross-sectional view of a dual vest guard of an embodiment of the present invention.
Figure 12:
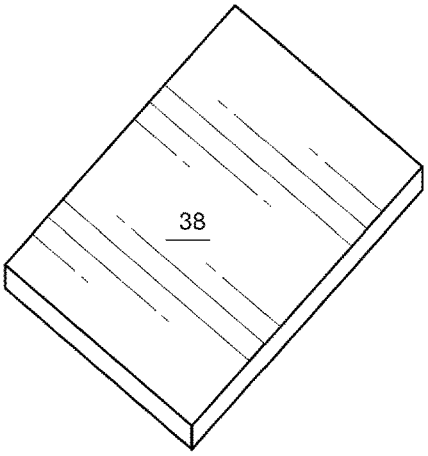
FIG. 12 PRIOR ART
FIG. 12 illustrates a rear view of a prior art frontal vest guard.
Figure 13:
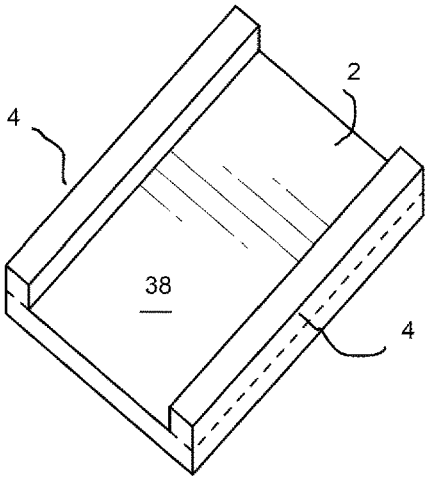
FIG. 13 illustrates a rear view of a frontal vest guard of an embodiment of the present invention.
Figure 14:
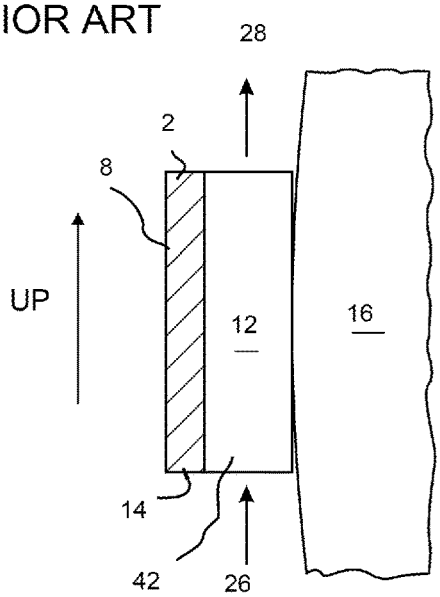
FIG. 14 illustrates a side cross-sectional view of a front vest guard of an embodiment of the present invention as worn by a user.

Alternative embodiments are shown in FIGS. 11, 13, and 14 in contrast with prior art shown in FIGS. 10 and 12. Frontal and dorsal panels 18 and 20 are set on torso, but with spacing elements, 4 interior surface 38 is set apart from body to form gaps 12 that allow for air flow from air intake 26 of cool air from below and warm/hot air outflow or exhaust 28. Gaps 12 may include both front airflow space 42 and dorsal air flow space 44. Ballistic carrier 2 include compartment 14 to hold rigid ballistic panel 8. For example, horizontal/lateral distance between spacing elements may be on the order often to twenty cm preferably 12-15 cm, and spacing elements may rise vertically 15 to 45 cm, preferably 18-27 cm, more preferably 23-25 cm. Thickness of spacing elements, as measured between carrier/plate to user shirt/user body, may be on the order of 2 to 4 cm, most preferably 2.5-3 cm. Width of spacing elements may be on the order of 3 to 8 cm, more preferably 3.5-6 cm, and most preferably 3.9-4.3 cm.

Figure 15:
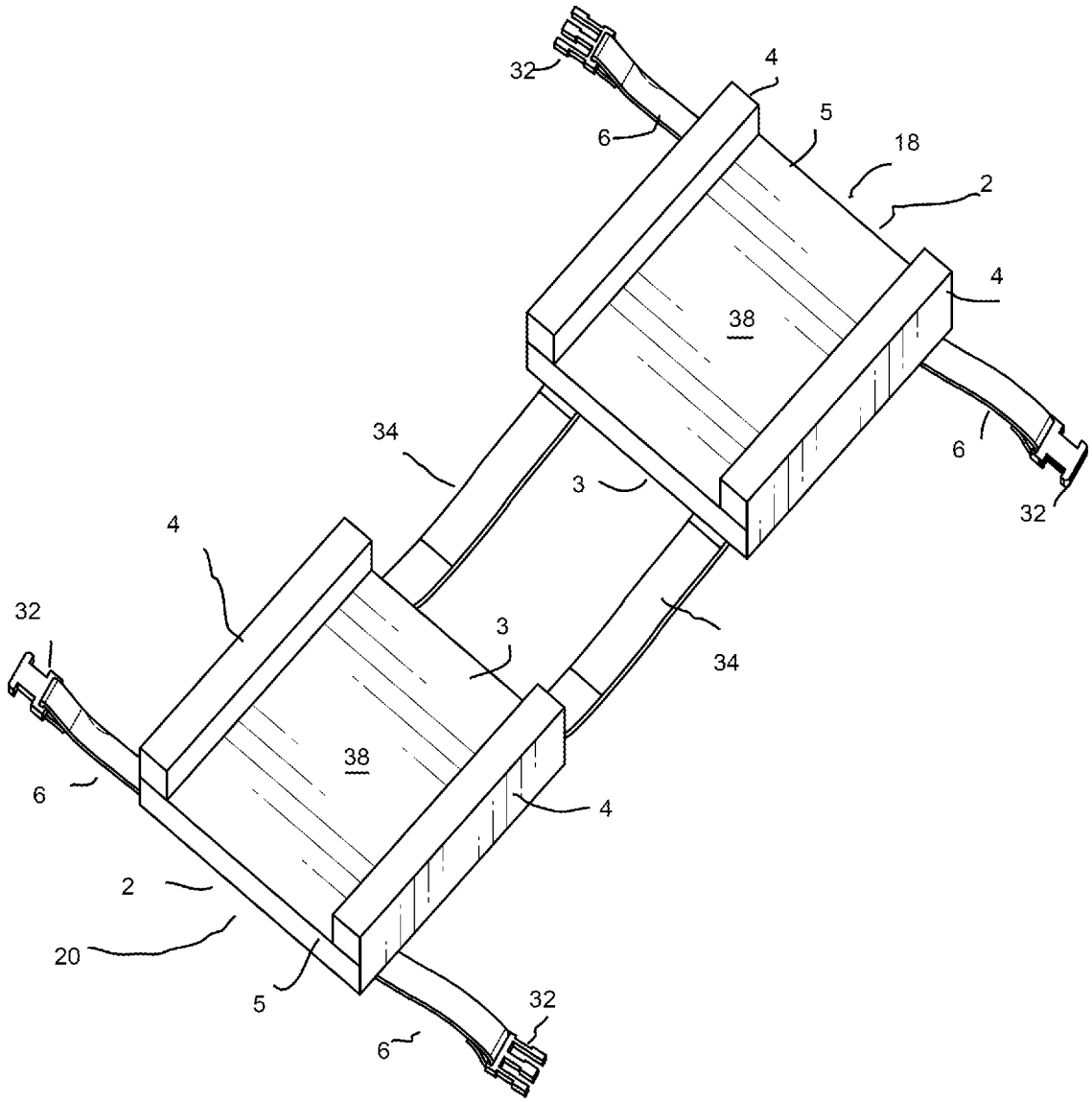
FIG. 15 illustrates an interior display of an unfolded dual carrier system of an embodiment of the present invention.
Figure 16:
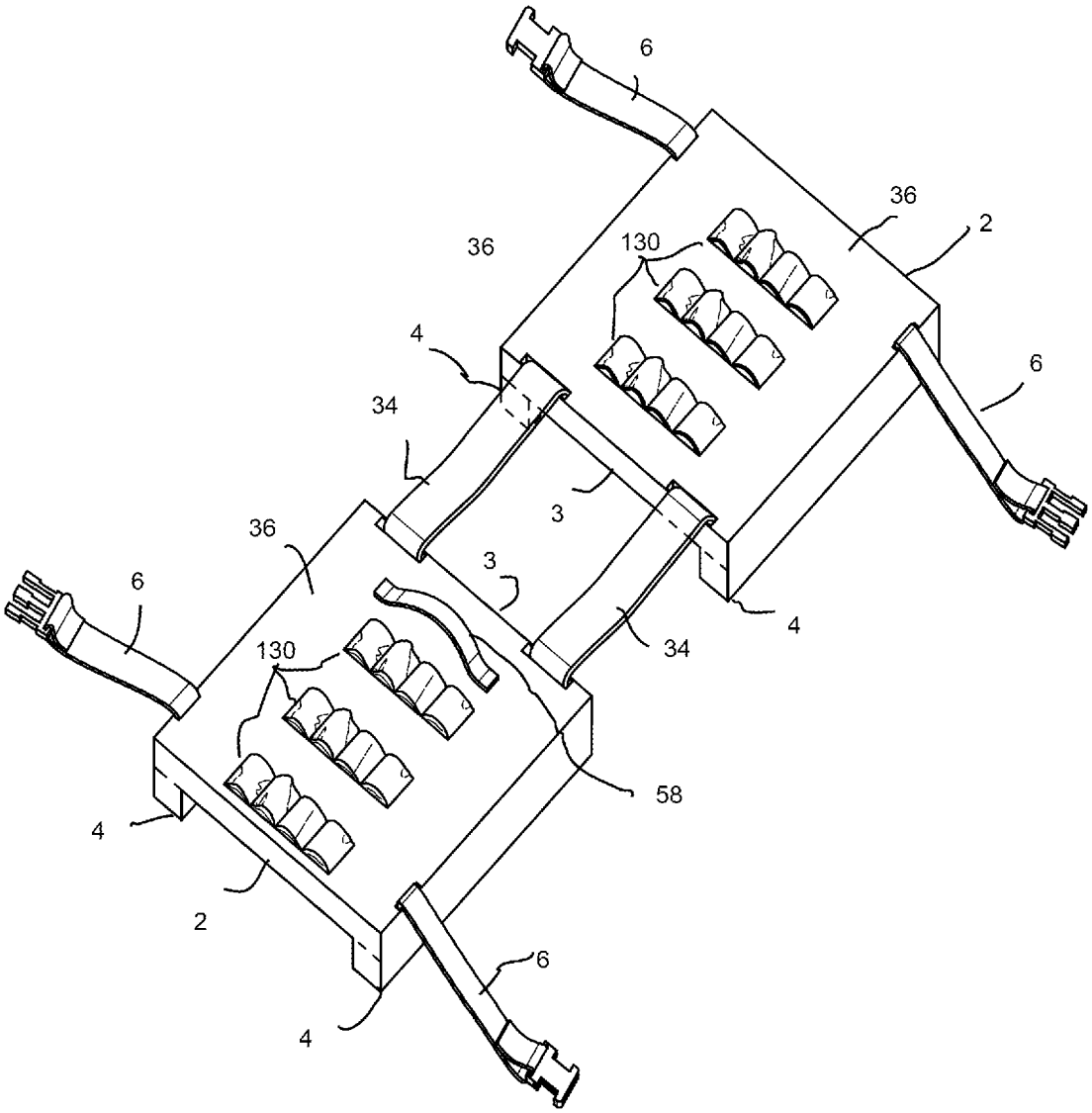
FIG. 16 illustrates an exterior display of an unfolded dual carrier system of an embodiment of the present invention.

FIGS. 15 and 16 demonstrate an alternative embodiment of the present invention with dual carriers for front and back. Front panel 18 is mated to rear panel 20 via a pair of shoulder straps 34 that serve to hang system over the shoulders with top 3 set towards the neck. Interior surface 38 is intended to face body and create an air gap between body/clothing and carriers 2 by spacing elements 4. Straps 6 and buckles allow the product to be buckled around the waist to further secure lower ends 5 of the system around the body. Outer surfaces 36 may include a grab handle 58, such as on rear carrier panel 20 to allow carrying system when not worn, or otherwise allow support personnel to assist lifting tor pulling the user. Equipment attachment points 130 allow for additional products to be mounted on system, such as pen holders, clips, loops, etc.

Figure 23:
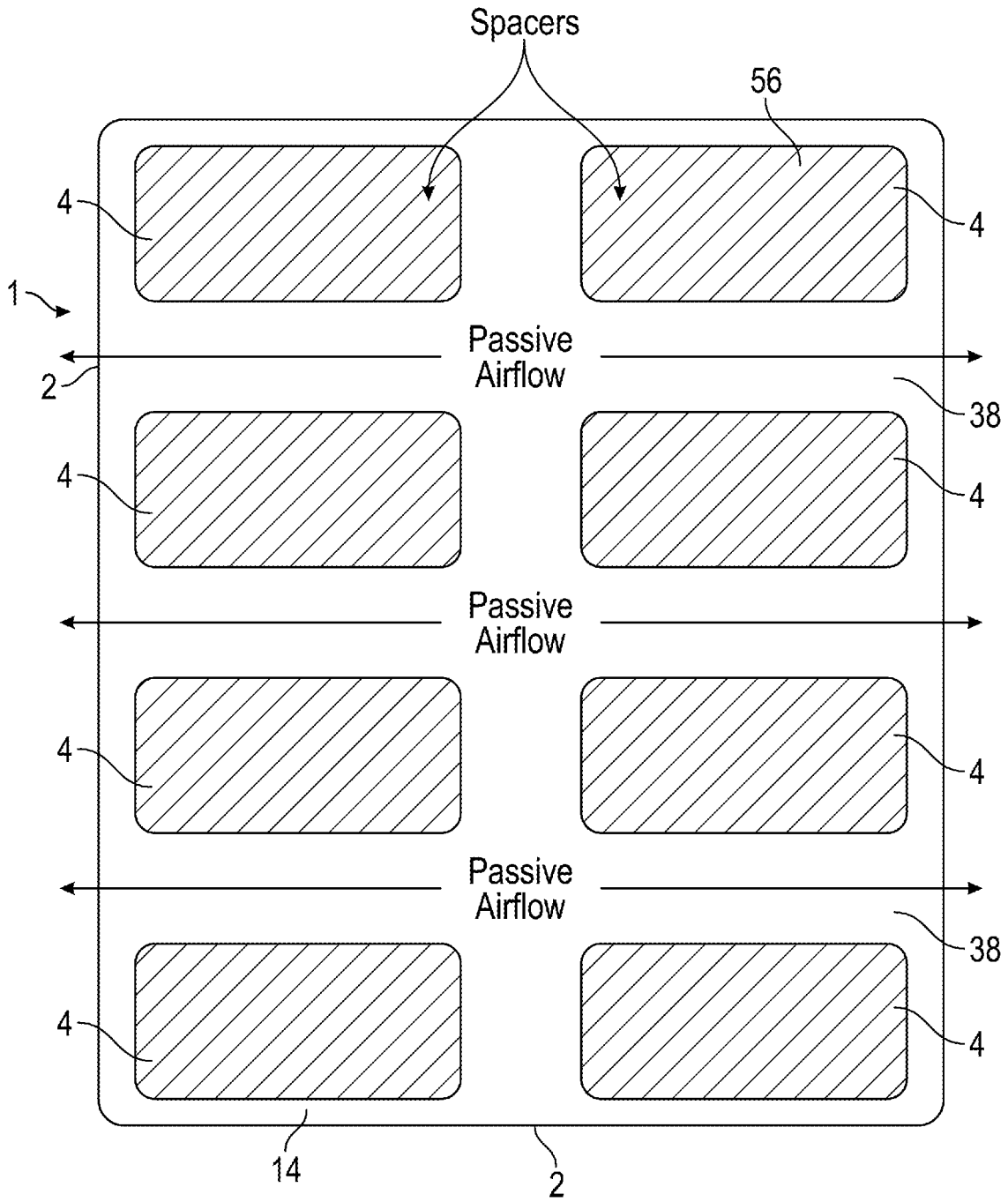
FIG. 23 (Prior Art)
FIG. 23 illustrates a rear plan view of a carrier and spacer system with cuboid spacers as known in the prior art.

FIG. 23 demonstrates an alternative embodiment with cuboid spacing elements similar to that known in the prior art. Cuboids 56 of spacing elements 4 allow for passive air flow laterally. Interior surface 38 of carrier 2 faces user. FIG. 23 is also an approximate representation of prior art plate carrier interior (one of the most advanced in terms of heat management). Flat, low, rectangular cuboids are an attempt to minimize contact with the wearer, but fail to cause active airflow. Interruptions from the vertical of spacing elements are large enough to interfere with an appropriate stack effect. As shown FIG. 25, a cross-section of an embodiment in FIG. 23 shows the disadvantages of its design. Simple rectangular bumps of foam are an attempt at improving ventilation between wearer and plate carrier.

In the present invention, polymerization reactor cooling technology is applied to the art of protective equipment wearer cooling. By using induction of air flow using stack effect in combination with optimization of carrier's wearer-facing 31) geometry, we can achieve good heat and mass transfer. The advantages of invention are shown by comparing the situation of prior art (FIG. 25) vs. that being disclosed (FIG. 26) via cross-section views.

Prior art designs trap perspiration under their "pads", where the distance for perspiration to travel to the nearest air channel is relatively long. These long distances slow the rate of perspiration removal. Prior art carrier designs have long distances for perspiration to travel, and once perspiration does reach an air space, the surface for accomplishing the mass transfer is small, leading to wearer discomfort. Further, air flow through the air space is very poor, the combination of these factors results in poor handling of perspiration and subsequent severe wearer discomfort. The present invention provides for very short path for perspiration (resulting in its rapid movement to the surface in contact with air flow). The surface area for perspiration evaporation is comparatively very large, resulting in rapid evaporation (mass transfer is optimized in accordance with invention description). Due to stack effect airflow, the air in the space is not stagnant but moving. In combination, all these factors provide a synergistic effect that gives wearer significantly enhanced comfort and cooling vs. prior art embodiments.

Figure 24:
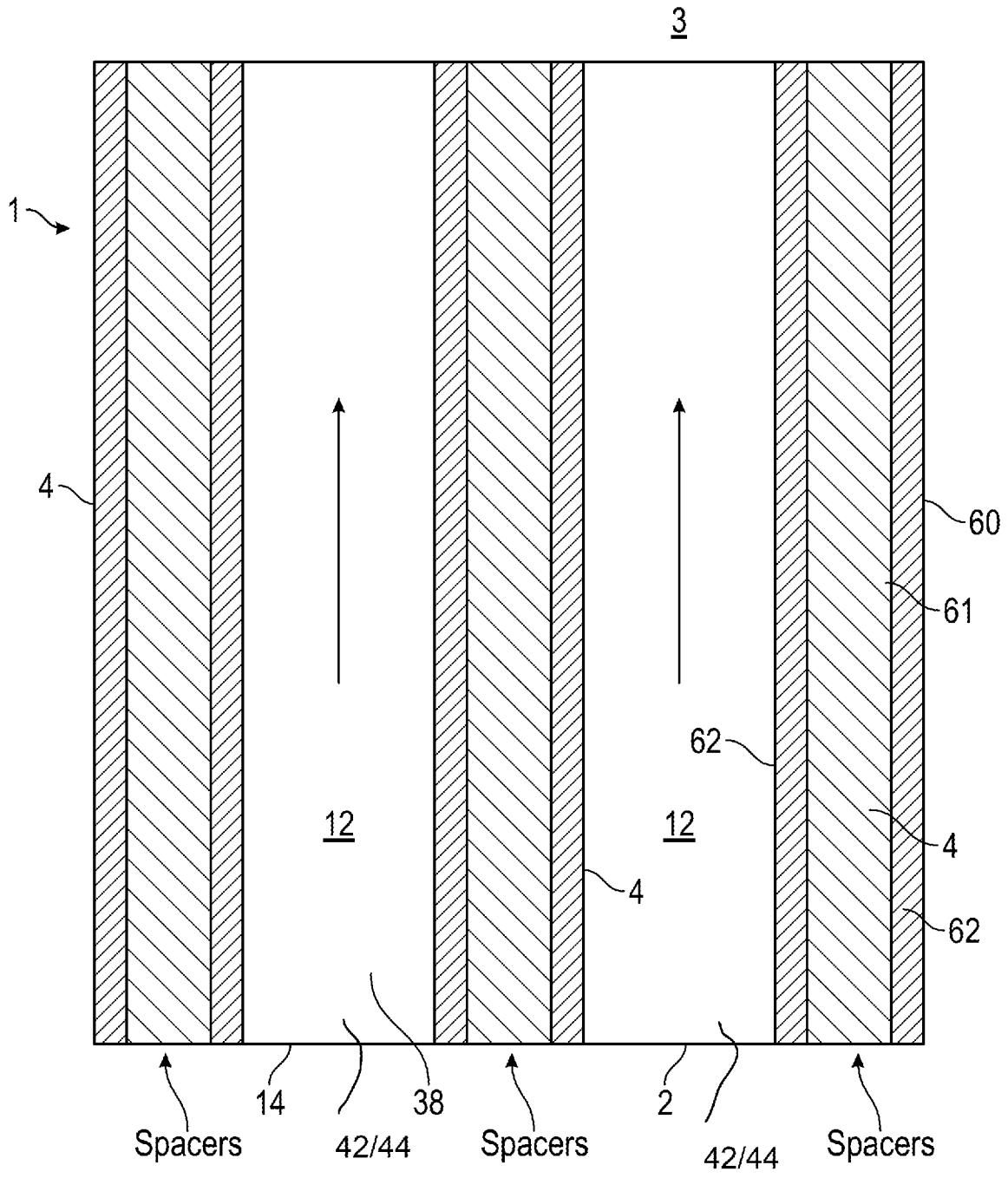
FIG. 24 illustrates a rear plan view of a carrier and spacer system with trapezoidal spacers of an embodiment of the present invention.
Figure 25:
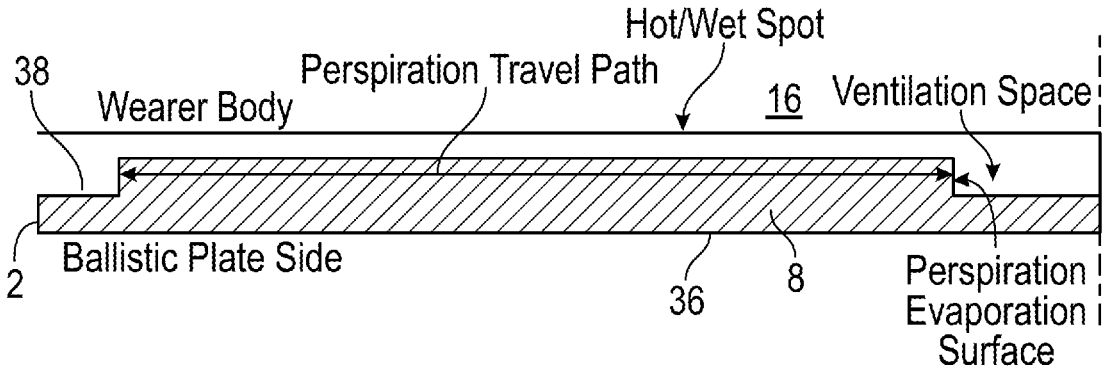
FIG. 25 (Prior Art)
FIG. 25 illustrates a top cross-sectional view of prior art guard system on a user's body.
Figure 26:
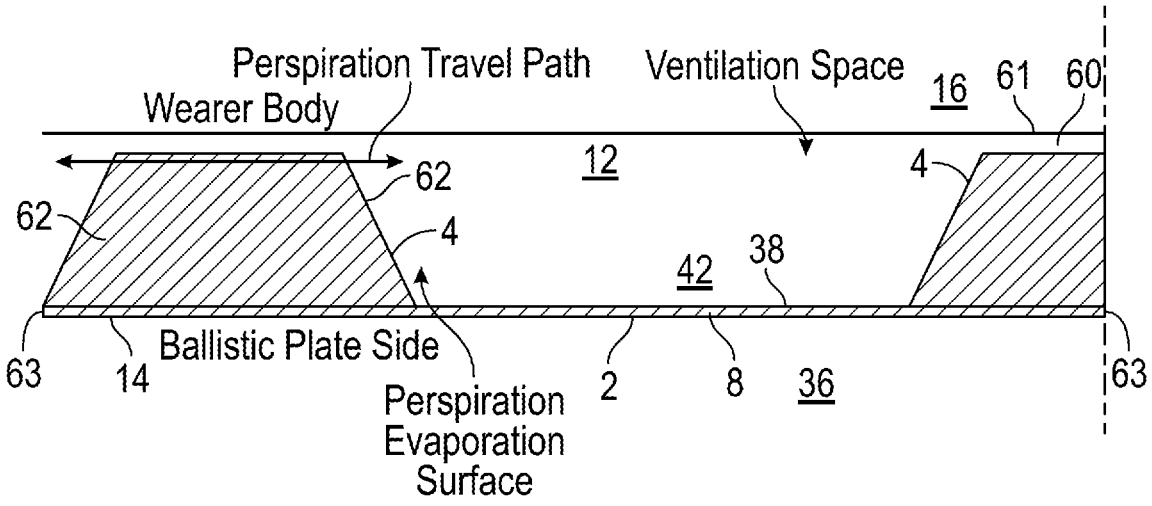
FIG. 26 illustrates a top cross-sectional view of a guard system of the present invention utilizing trapezoidal spacers embodiment.

FIGS. 24 and 26 demonstrate how trapezoidal spacing elements 60 can improve over the prior art of FIG. 25 by minimizing interior surface contact with user. Stack effect air flow is caused to occur in gaps 12 between spacing elements and the user and the interior surface 38. Carrier 2 includes compartment 14 with rigid plates. In these embodiments, the spacers are preferably approximately 20 mm thick to give space, while the compartment with plate is preferably 2 mm thick. Trapezoidal spacers 60 include a body facing narrow top surface 61, angled sides 62, and bottom/base 63 (preferably parallel with top 61). When the plate is contoured to ergonomically fit the body, the tops may be offset from parallel to encourage gradual bending of system around body.

The "stack effect" is preferably applied and achieve through the embodiments of the present invention. Minimum practical height (vertical dimension) (dimension along the general line of free ascent of hot air) is about 7-10 cm. Below that height, the stack-effect-induced flow rate is too low, according to the formula, to effectively help with cooling, although optimal spacer geometry along lines of contact with wearer will always achieve some degree of heat transfer regardless of how "tall" the spacer is in the vertical dimension. However, the invention is improved by the synergistic effect of both stack effect and mass transfer, making 7 cm is the minimum (assuming typical temperatures for human, environment, and reasonable distance from equipment to body achieved via spacers).

In practice, preferred range of vertical spacer dimensions begins at about 15 cm (about 6" for non-metric people) because that is the common size for smallest protective panels (armor and athletic equipment). As discussed, it is important for designers incorporating the inventive technology to make the spacers as long as reasonably possible in the vertical dimension. The higher the space created via spacers in the vertical dimension, the greater the air flow rate per unit of time will be created (ceteris paribus). Further, greater height leads to greater surface area of wearer exposed to cooling air flow within the space, and thus further enhances heat transfer (which is roughly proportional to the surface area available for giving off heat) and therefore the entire system's cooling performance will be enhanced when the space for air flow is maximized as reasonably possible without creating a device that is too bulky or too unwieldy. It should be noted that the greater airflow gained by a "taller" space also enhances the mass transfer rate of perspiration from the spacers themselves, as well as from the wearer's surface exposed to airflow. Greater rate of airflow derived from a "taller" space is also known to enhance the rate of cooling per unit area. Thus, the synergistic effect of "taller" space together with spacer geometry of the instant invention is enhanced.

By "width" of spacing elements, we refer to the spacers' line of contact with the wearer in the horizontally-cross-secting plane. Spacers should not be wider than about 5 cm in this dimension, and are preferably about 1-3 cm, more preferably 1.9-2.5 cm. in this dimension. They should not be any narrower than about 0.5 cm (in this case, even with 7 spacers and lighter plates, discomfort is significant due to pressure from plates being concentrated in a small surface if width is under about 0.5 cm). Spacers can be square or rectangular in cross-section. However, they can also be significantly wider (e.g. semicircular, trapezoid in cross-section) at points away from the line of wearer contact (as illustrated in FIG. 26 and as shown in photos of experimental designs). This is usually done when the spacers need additional mechanical strength without incurring a "penalty" in terms of additional coverage of the wearer's line of contact with spacers. For example, when the carrier contains relatively heavy ballistic plates and/or a significant weight of other equipment, devices, ammunition, weapon(s), etc., this can lead to spacer collapse if spacers are rectangular, produce relatively large amount of offset from wearer, and are narrow throughout. By being wider at locations away from contact with wearer, they can be mechanically stronger without resorting to harder materials that are less comfortable to wear for extended periods of time. Note that it is important to measure the spacer width along the line of wearer contact when the article of invention is being worn, NOT when manufactured, since pressure on spacer can cause its line of contact to become significantly greater than it appears when not used, due to interaction between spacer and wearer.

By "thickness" of spacer we mean the distance created via same between the wearer and the inner surface of protective plate and/or its carrier (whichever is closer to the wearer). Inner surface in this case means the location of the furthest points of the inner surface (carrier or plate) from the wearer in the horizontally-cross-secting plane described above, measured along a line perpendicular to the protective gear's innermost location. It is important to note that the spacer thickness is measured as worn, not as made, since it is expected that spacers will experience some compression due to weight of protective gear. Further, it is understood that wearer anatomy (male and female) will result in variation of distance between different points of the wearer and the inner surface of protective gear.

Preferred spacer thickness is at least about 2.0 cm, preferably between 1.5 and 3 cm, and more preferably between 2.0 and 2.2 cm, the maximum being dependent on specific application and dependent on convenience, but typically is no greater than about 20 cm (generally in some varieties of athletic gear at the extreme bottom of devices to help them maintain a more vertical alignment when the player is leaning forward). The smallest thickness of spacer is about 1.0 cm. Note that it is obvious that some parts of the panel will be closer to the wearer than these minimums. In practice, when insufficient thickness of spacer is occurring, this will lead to the occlusion of the airflow space of the invention, and the cooling function will cease. Depending on specific design decisions, spacer parts' size needed to achieve the required minimum approximate 1.0 cm effective spacer-generated distance from wearer body to the protective gear inside surface may be significantly larger than said 1.0 cm.

As far as angle away from vertical, about 30 degrees or less is preferred for convenience in use of system, about 15 degrees is most preferred, about 60 degrees is "not to exceed" due to convenience reasons (but is definitely less effective). The angle may be offset in a lateral dimension along the plane of the plate, and/or via contours to match the shape of the wearer's body.

We claim:

1. A system for enabling airflow and enhanced cooling effects for use as part of protective clothing with rigid plate(s), said system comprising:

a carrier comprising at least one compartment; at least one rigid protective plate supported by said compartment, said rigid protective plate compromising a hard armor panel, and said compartment located along a side of a torso of a wearer;

a plurality of vertical spacing elements said plurality of vertical spacing elements being substantially continuous and positioned between an interior surface of the rigid protective plate and the torso; said plurality of vertical spacing elements providing space between torso portions of interior surface, and preventing portions of interior surface between said plurality of spacing elements from contacting the torso; and at least one air gap, said at least one air gap formed between the interior surface of the carrier and the wearer and at least one adjacent vertical spacing element, said air gap providing an open-air space extending vertically between a bottom cooling opening and a top exhaust opening.

2. The system of claim 1 wherein each of said plurality of vertical spacing elements possesses a narrow contact surface between one to five centimeters directed towards the wearer's torso.

3. The system of claim 1 wherein the number of said plurality of vertical spacing elements numbers between two and seven per each of said at least one compartments.

4. The system of claim 1 wherein the number of said at least one air gap does not exceed six air gaps per compartment.

5. The system of claim 1 wherein at least two of said plurality of vertical spacing elements are set in parallel with one another.

6. The system of claim 1 wherein said plurality of vertical spacing elements comprises two spacers at the right and left edges.

7. The system of claim 1 wherein said carrier is coupled to at least one pair of straps.

8. The system of claim 1 wherein said carrier further comprises an outer foam layer set outward of said compartment.

9. The system of claim 1 wherein each of said plurality of vertical spacing elements is laterally covered by mesh.

10. The system of claim 1 wherein each of said plurality of vertical spacing elements is cylindrical.

11. The system of claim 1 wherein each of said plurality of vertical spacing elements is trapezoidal with a small of two parallel sides facing the wearer's torso.

12. The system of claim 1 wherein said compartments are arranged around the torso for at least a total of four compartments, each of said compartments receiving at least one rigid panel.

13. The system of claim 1 further comprises a plurality of angled spacing elements stacked above each of said plurality of vertical spacing elements is laterally covered by mesh.

14. The system of claim 13 wherein each of said plurality of angled spacing elements is angled toward the thorax.

15. The system of claim 1 further comprising a second carrier, said second carrier comprising a plurality of vertical spacing elements, and at least a second rigid protective plate set within an at least second compartment.

16. The system of claim 15 wherein said carrier and said second carrier coupled via at least two straps.

17. The system of claim 1 wherein each of said plurality of vertical spacing elements is a rectangular cuboid; and wherein at least two vertical spacing elements are arranged vertically relative one another with a horizontal air gap set therebetween.

18. The system of claim 1 wherein said plurality of vertical spacing elements are directly affixed to the rigid protective plate.

19. The system of claim 18 wherein said plurality of vertical spacing elements associated with a particular rigid protective plate include a vertical cylindrical body along left and right ends of the plate and a hemicylindrical plate with a flat end directed towards said rigid protective plate.

20. A method of creating a cooling air flow in the space between the wearer and the interior surface of the system, comprising the steps of:

locating the system of claim 1 on the wearer's torso to provide wearer protection from ballistic and/or blunt impacts, whereby the plurality of spacing elements are set against the torso, and the interior surface is separated from the torso to provide the air gaps;

arranging the plurality of vertical spacing elements to cause a "stack effect" induced air flow, whereby the airflow passing through the space(s) is/are channeled by one of the vertical elements, the airflow channel defined by interior surface of the compartment and the wearer, whereby the top and bottom of the channel being open to ambient air.

21. The method as set forth in claim 20 whereby the airflow causes mass transfer of perspiration and humid air.

22. A method of a cooling air flow in the space between the wearer and the interior surface of the system, comprising the steps of:

locating the system of claim 15 on the wearer's torso to provide wearer protection from ballistic and/or blunt impacts, including one carrier set dorsally and a second carrier set frontally;

whereby the plurality of spacing elements are set against the torso, and the interior surface is separated from the torso to provide the air gaps;

arranging the plurality of vertical spacing elements to cause a "stack effect" induced air flow, whereby the airflow passing through the space(s) is/are channeled by one of the vertical elements, the airflow channel defined by interior surface of the compartment and the wearer, whereby the top and bottom of the channel being open to ambient air.

* * * * *